US005509257A

United States Patent [19]

Tagliaferri et al.

[11] Patent Number: 5,509,257

[45] Date of Patent: Apr. 23, 1996

[54] PACKAGING MACHINE FOR WITHDRAWING AND OPENING FLAT FOLDED CASES AND FOR FILLING THEM WITH RELATIVE ARTICLES

[75] Inventors: Roberto Tagliaferri, Castel S. Pietro Terme; Franceschi Giancarlo, Budrio; Marzocchi Paolo, Castel S. Pietro Terme, all of Italy

[73] Assignee: I.M.A. Industria Macchine Automatiche S.P.A., Ozzano Emilia, Italy

[21] Appl. No.: 426,068

[22] Filed: Apr. 21, 1995

[30] Foreign Application Priority Data

Apr. 29, 1994 [IT] Italy ..... BO94A0181

[51] Int. Cl.[6] ..... B65B 5/04; B65B 43/18; B65B 43/20; B65B 43/30

[52] U.S. Cl. ..... 53/566; 53/252

[58] Field of Search ..... 53/458, 566, 574, 53/251, 252, 257

[56] References Cited

U.S. PATENT DOCUMENTS

| | | | |
|---|---|---|---|
| 3,300,946 | 1/1967 | Martin | 53/566 X |
| 3,633,470 | 1/1970 | Bingham | 53/566 X |
| 3,879,920 | 4/1975 | Langen | 53/252 X |
| 4,012,887 | 3/1977 | Calvert et al. | 53/566 X |
| 4,519,181 | 5/1985 | Sherman et al. | 53/566 X |
| 5,127,894 | 7/1992 | Maccaferri | 53/566 X |
| 5,388,389 | 2/1995 | Tisma | 53/252 X |

*Primary Examiner*—Horace M. Culver
*Attorney, Agent, or Firm*—McAulay Fisher Nissen Goldberg & Kiel

[57] ABSTRACT

The packaging machine comprises a feeding line equipped with belt conveyors for conveying flat folded blanks withdrawn thereby from a magazine. An erecting station, situated downstream of the withdrawing station, is provided with a rotating head featuring gripping means with suction cups aimed at cooperating with second suction cups to open adjacent edges of the blanks. Upper runs of belt conveyors of a packaging line situated below the feeding line, are designed to cooperate with the lower run of the conveyor so as to hold the cases obtained from the blanks. Pushers are located at the side of a feeding line placed at the side of the packaging line for feeding the articles, and are operated axially in order to introduce the articles into the cases. Means are provided for adjustment in accordance with the height of the cases, and move vertically a group comprising the feeding line. Means are provided for transversal adjustment performed by means of a centralized control member acting on means for changing width of the lines and and of the magazine.

18 Claims, 23 Drawing Sheets

FIG. 16 a
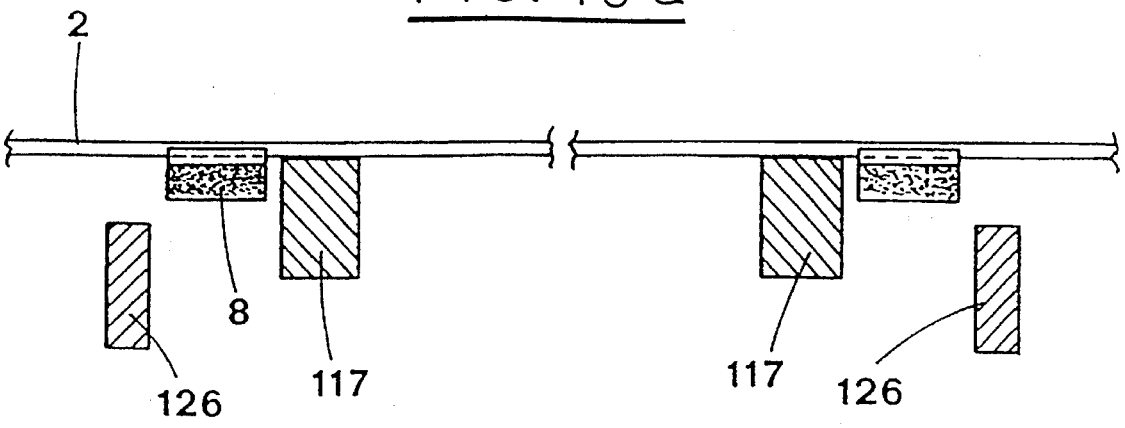
FIG. 16 b
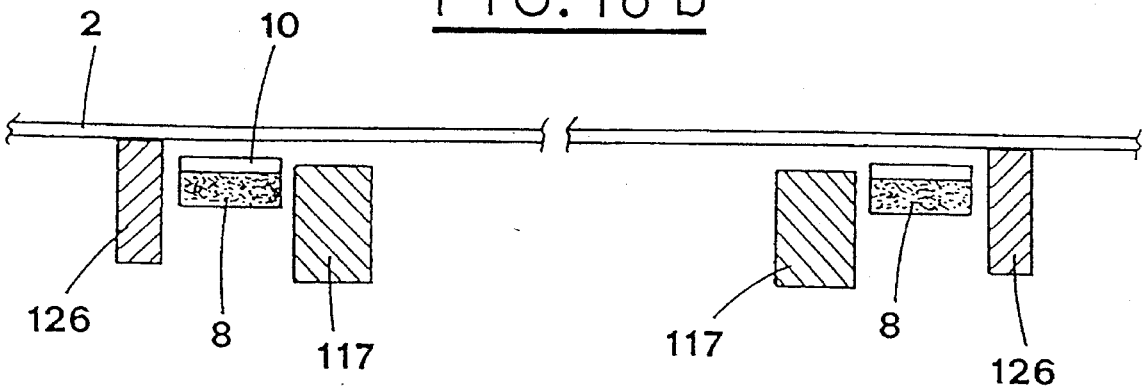
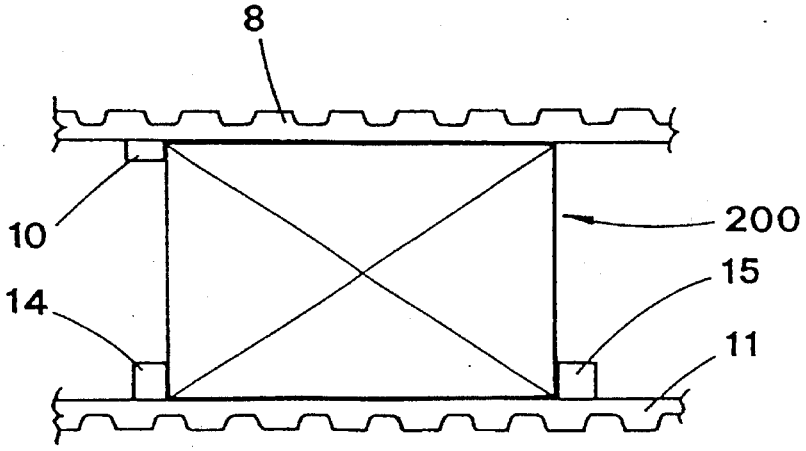
FIG. 1a 20
31
22
24
30
34
23
32
28
26
VIII
27
VIII
37
39
VII
38
237
236
VII
33
X
VI
VI
234
36
35

116b
10

127

128
121
120
125
116b
2
123
119
122
124
126

2
XVI
XVI
116a
8
118
10
126a
118
8
117

FIG. 22
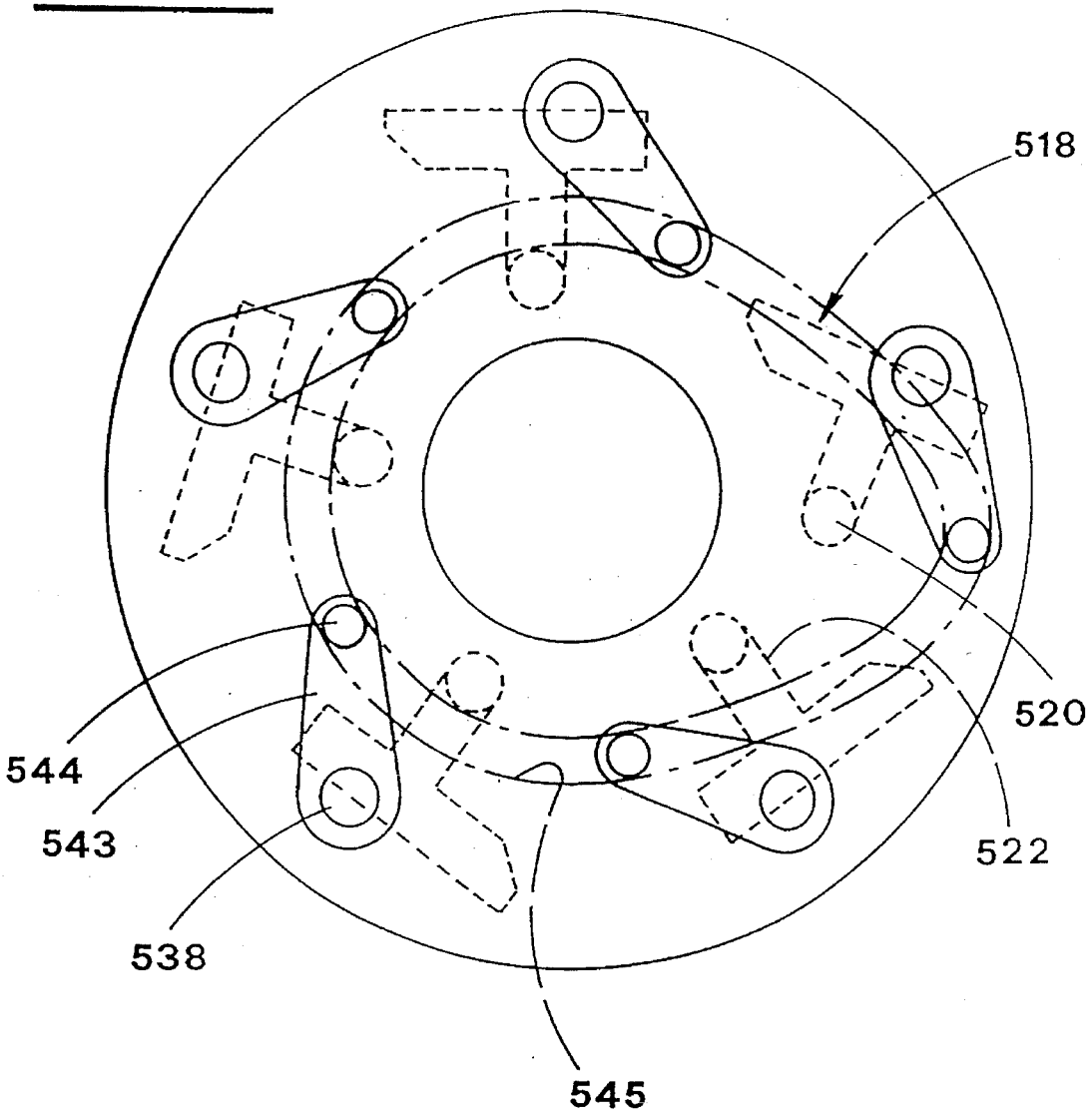
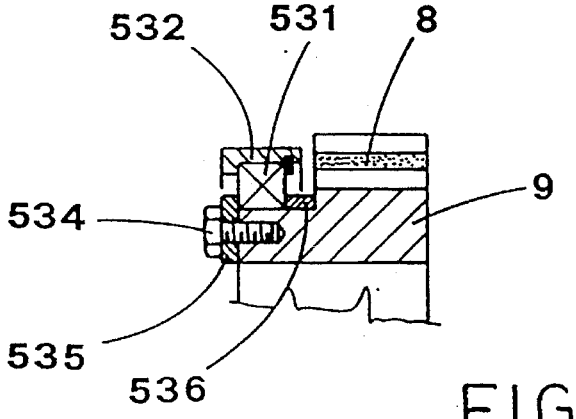
FIG. 23

PACKAGING MACHINE FOR WITHDRAWING AND OPENING FLAT FOLDED CASES AND FOR FILLING THEM WITH RELATIVE ARTICLES

BACKGROUND OF THE INVENTION

The present invention relates to packaging of articles in cases obtained from blanks which are stored in flat folded configuration.

DESCRIPTION OF THE PRIOR ART

It is known, in the packaging of various products, to use box-shaped cartons obtained from semirigid material blanks, e.g. carton or longitudinally pre-glued cardboard.

Generally, these blanks are stored in flat folded condition in a suitable magazine, from which they are removed one by one to be opened and transferred to the product packaging line.

Automatic packaging machines that withdraw the blanks from the magazine, open them in cases, and introduce articles therein are known.

However, these machines present considerable drawbacks when the blanks size must be changed in relation with different dimensions and/or characteristics of the articles to be packaged.

In fact, in such a situation it is necessary to adjust not only the magazine width, but also the position of means supporting the stack of blanks inside the magazine and the conveyors carrying the cases along the feeding and packaging lines.

Adjusting operations are usually complicated and often require expert staff that results in increase of production costs.

Known machines are also equipped with suction means for withdrawing blanks from the bottom of the magazine, that cooperate with fixed and/or movable stops for opening the blanks and with chain means for carrying the blanks to the feeding line.

All this results in great overall dimensions and constructive complications, whose negative effect is specially noticed when the size is changed.

Moreover, such handling provoke stresses on the blank walls that can tear and/or damage cases obtained from the blanks.

Known machines are provided also with means, situated downstream of the opening station, for facilitating introduction of the blanks between corresponding trailing and holding means featured by the packaging line; also these means increase the dimensions and constructive complications, specially during the size change.

Also in this case, the case walls can be stressed and, consequently, damaged.

Furthermore, the mutual situation of the packaging and feeding lines, and of the articles feeding line, as well as the station for introducing the articles into the cases, is not advantageous for the size and, specially for handling and maintenance of the machine.

SUMMARY OF THE INVENTION

The object of the present invention is to propose a packaging machine that in the best way withdraws and opens the blanks, introduces articles into the set up cases, allowing to simplify change over operation in accordance with the blanks size.

Further object of the invention is to propose a machine whose conveyors do not employ chains that results in easier lubrication, reduced noise and easier maintenance.

Still further object of the present invention is to propose a machine in which the upper run of the blanks feeding line withdraws the blank from the bottom of the magazine and feeds it directly to the opening station.

Another object of the present invention is to provide a lower run of the feeding line that, together with other conveyors, forms the packaging line.

Yet another object of the present invention is to provide an opening station and a packaging line that allow the opened blanks to be gently carried from the said station to the holding and conveying means featured by the packaging line.

A final object of the invention is to provide a machine in which the mutual position of the blanks feeding line and packaging line, of the articles feeding line and the station introducing them into the relative cases of the packaging line, of the magazine and blanks opening station, minimizes the overall dimensions, reduces assembling time and optimizes the interventions of the maintenance staff.

In accordance with the invention, packaging machine for withdrawing flat folded carton blanks from a magazine where said carton blanks are stored in flat folded condition to form a stack, and for and erecting and fill said cases with relative articles, includes:

a blank feeding line, cantilever supported by a fixed frame structure and equipped with first belt conveying means for conveying blanks withdrawn from said magazine, in flat folded condition;

a withdrawal station where said flat folded blanks are withdrawn from said magazine, said withdrawal station being situated along said blank feeding line and equipped with bars for supporting a stack of blanks, and with stop means aimed at cooperating with the same bars so as to define a passage through which a single flat folded blank is withdrawn by the said first belt conveying means;

an carton erecting device, situated downstream of the said withdrawal station and comprising a rotary member that carries gripping means located along the periphery of the said rotary member and including suction cups mounted on respective shafts pivoting on a rotary drum coaxial to and rotated in synchrony with said rotary member;

further gripping means including suction cups situated over said rotary member and operated in phase relation with the said gripping means between a gripping position, in which said suction cups grip at opposed sides a flat folded blank, and an opening position in which adjacent wall panels of said blank are opened;

a packaging line situated below the said blank feeding line and parallel thereto, supported in cantilevered fashion by the said fixed frame structure and equipped with second belt conveying means aimed at cooperating with a lower run of said first belt conveying means, so as to hold the cases, obtained from the said blanks, while conveying them;

an article feeding line situated at the side of the packaging line, in intermediate position with respect to the said fixed frame structure for feeding articles to be packaged;

a plurality of pushers carried along a closed path, that extends along a straight section at the side of the article feeding line, moved with a speed equal to the speed of said article feeding line, said pushers being operated axially when they run the above mentioned straight section, so as to push the articles inside respective cases;

first adjustment means aimed at moving vertically a group comprising the said withdrawal station, said blank feeding line, and said carton erecting device, for adjusting height of said group in accordance with the height of the cases to be packaged, in such a manner that the distance between the lower run of the said belts conveying means first and second of the said packaging line is changed accordingly;

second adjustment means equipped with a centralized control member aimed at operating, by means of flexible transmission means, actuating means for changing width of the blank feeding line, of the packaging line and of the magazine in accordance with the length of the cases to be packaged.

BRIEF DESCRIPTION OF THE DRAWINGS

The above mentioned objects are obtained in accordance with the contents of the claims.

The characteristic features of the present invention are pointed out in the following description with reference to the enclosed drawings, in which:

FIG. 1*a* shows an enlarged view of particular P of FIG. 1;

FIGS. 16*a* and 16*b* shows respectively a schematical sectional view taken along line XVI—XVI of FIG. 14, in different working configurations;

FIG. 22 shows a sectional view of means operating the opening device, taken along line XXII—XXII of FIG. 20;

FIG. 23 shows a sectional enlarged view of a particular of the opening device, taken along line XXIII—XXIII of FIG. 21*b*.

DESCRIPTION OF THE PREFERRED EMBODIMENT

Figure 1:
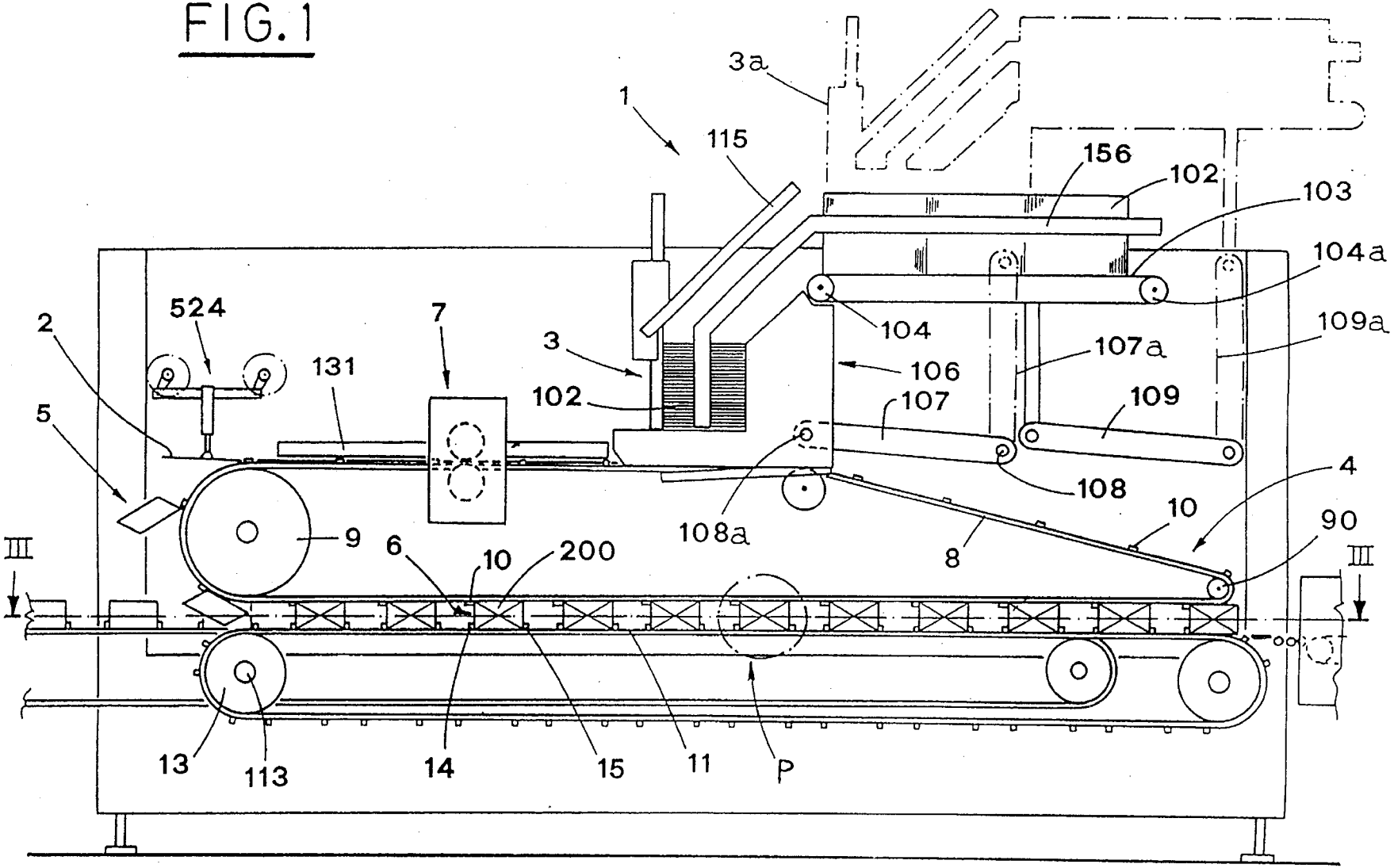
FIG. 1 shows an overall schematic side view of the subject machine.

Referring now to the drawings, the subject packaging machine includes a station 1 for withdrawing and feeding blanks 2.

The blanks 2 are stored in a stack inside a magazine 3, in flat folded condition.

The blanks withdrawal station 1 is situated along a line 4 that feeds these blanks 2 to an erecting device 5 for opening the same blanks to obtain cases therefrom.

The cases already opened are conveyed to a packaging line 6 situated below the feeding line 4 and parallel thereto.

Known means 7 for printing messages on the blanks 2, are placed along the feeding line 4, downstream of the withdrawal station 1.

The feeding line 4 includes a pair of toothed belts 8, arranged side by side and trained around fore pulleys 9, situated in correspondence with the erecting device 5, and on rear pulleys 90.

On their outer surface, the toothed belts 8 feature a plurality of equidistant lugs 10, aimed at withdrawing and trailing the flat blanks 2.

The packaging line 6 includes a pair of double toothed belts 11, 12 that are trained, below the erecting device 5, around coaxial and joined pulleys 13, 13*a* (FIG. 20), mounted on a shaft 113; at the back, the belts 11, 12 are trained by similar joined pulleys.

Also the belts 11, 12 have, on their outer surfaces, a plurality of equispaced lugs 14, 15, aimed at acting as fore and rear stops for the cartons already set up which are conveyed along the packaging line 6, indicated with 200 for the sake of clarity.

More precisely, the lugs 14 of the innermost belts 11, with reference to the packaging line 6 act as a fore stop, while the lugs 15 of the outermost belts 12 act as a rear stop for the cartons 200.

Therefore, the distance between these couples of lugs 14, 15 defines the holding space for each carton to be packaged.

It is possible to change this distance, according to different cartons sizes, by changing the reciprocal angular position of the pulleys 13, 13*a* of the belts 11 with respect to those of the belts 12.

Figure 11:
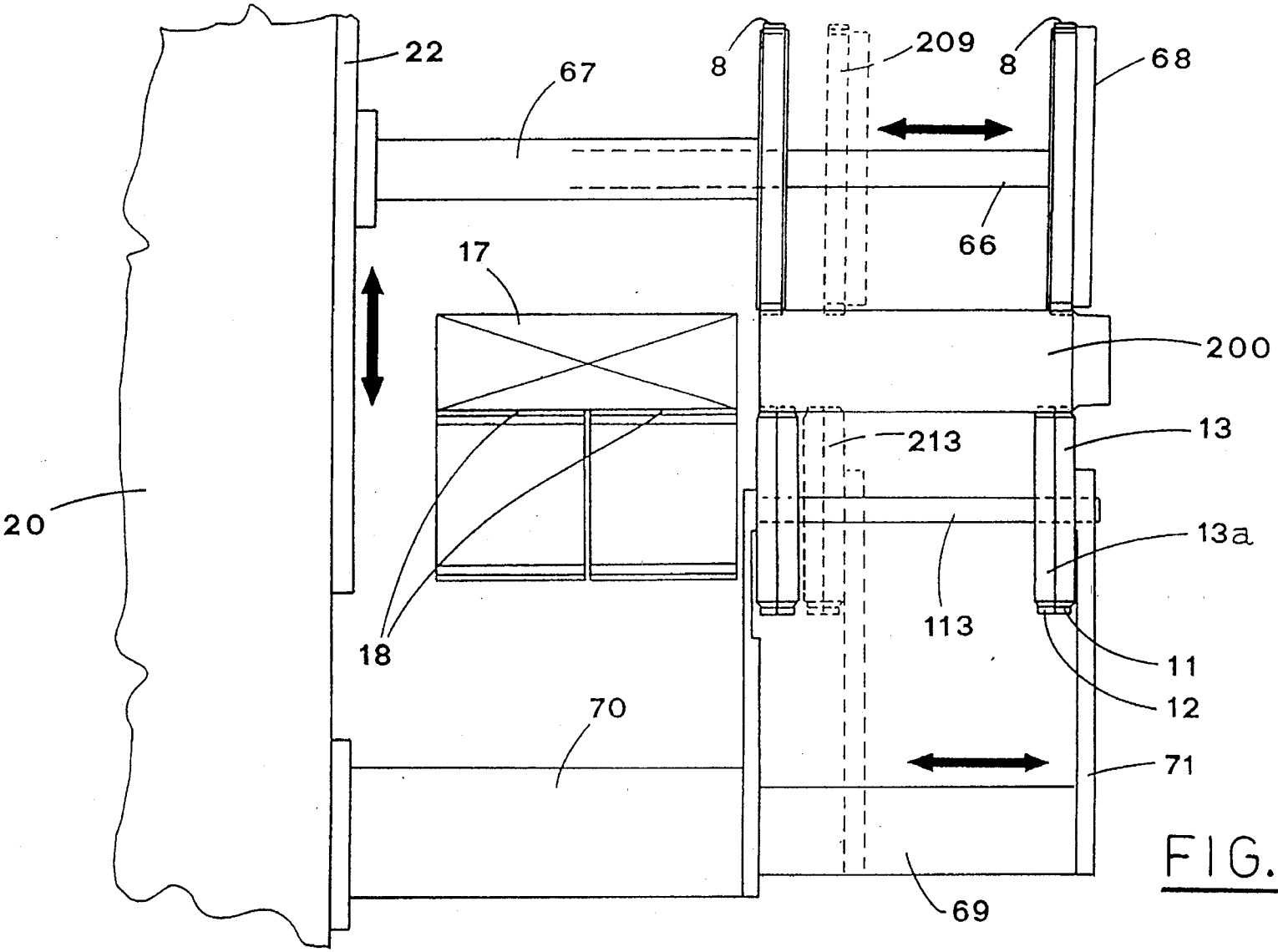
Figure 20:
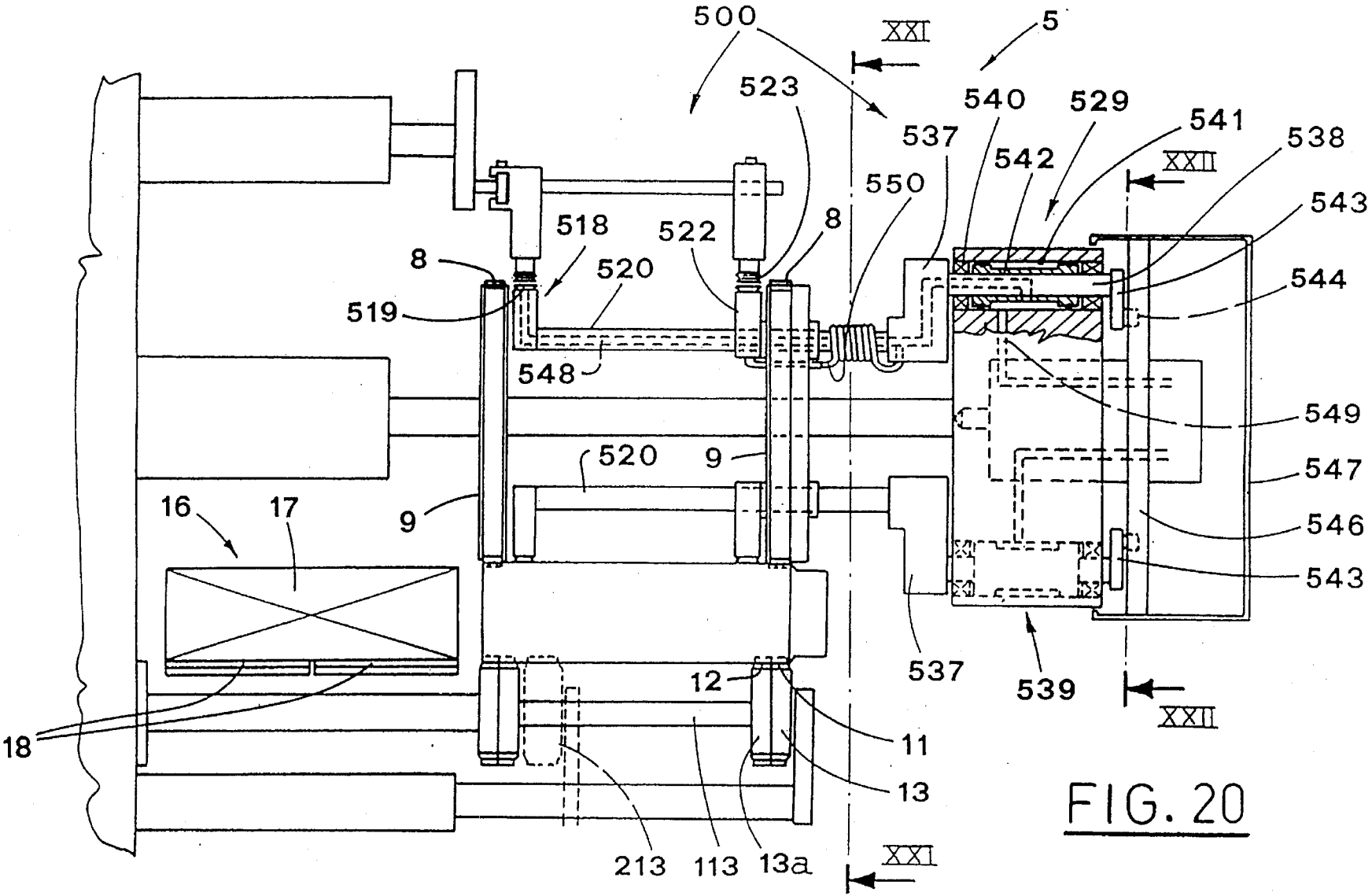
FIG. 20 shows a vertical sectional view of the blanks opening device, transversal to the packaging line.

It is also possible to change the distance between the two pairs of belts 11, 12, in accordance with the cartons longitudinal size, by moving axially a pair of pulleys 13, 13*a*, as shown with broken line 213 in FIGS. 11 and 20.

Likewise, the distance between the belts 8 of the feeding line 4 can be changed by changing the distance between the respective fore pulleys 9 and, accordingly, between the rear pulleys 90 (FIGS. 1, 20).

The lower run of the belts 8 cooperates with the belts 11, 12 of the packaging line 6, so as to retain the cartons 200 at the top (FIG. 1*a*).

Actually, the two pairs of lugs 10, 14 push the back of the cartons as trailing means, while the pair of fore lugs 15 retain the carton in the set up condition, preventing it from partial folding due to the material elasticity.

As seen in the particular P shown enlarged in figure la, the lugs 10 of the belts 8 are considerably lower than the teeth 14, 15 of the belts 11, 12 so as to facilitate opening of the blanks 2 for the device 5.

Figure 2:
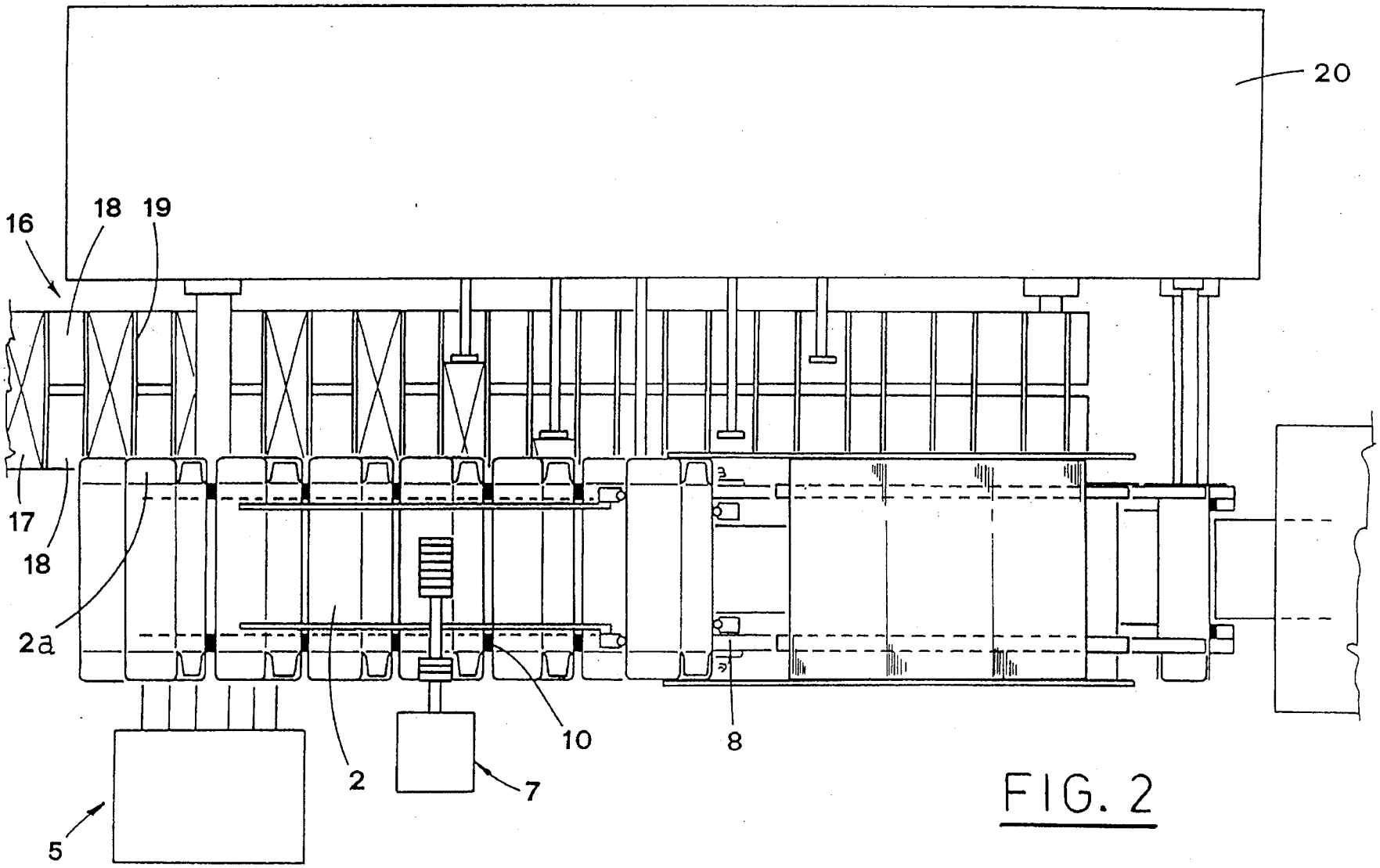
FIG. 2 shows a plan schematic view of the machine.

The feeding line 16 for the articles 17 to be packaged in the cartons 200, is situated at the side of the packaging line 16 (FIG. 2).

The feeding line 16 comprises e.g. a pair of conveying belts 18, arranged side by side, whose upper run is operated on the surface a bit upper than the conveying surface of the cartons 200 along the packaging line 6.

The belts 18 feature a plurality of transversal splines 19, aimed at defining a kind of drawers designed to contain the articles 17 to be packaged.

Actually, in packaging steps, these drawers are in alignment with correspondent cartons 200 to be filled, conveyed along the packaging line 6.

The line 4 for feeding the blanks 2, the packaging line 6 and the line 16 for feeding the articles 17 are cantilever supported on one side of a fixed frame structure 20, comprising the machine driving means.

Figure 3:
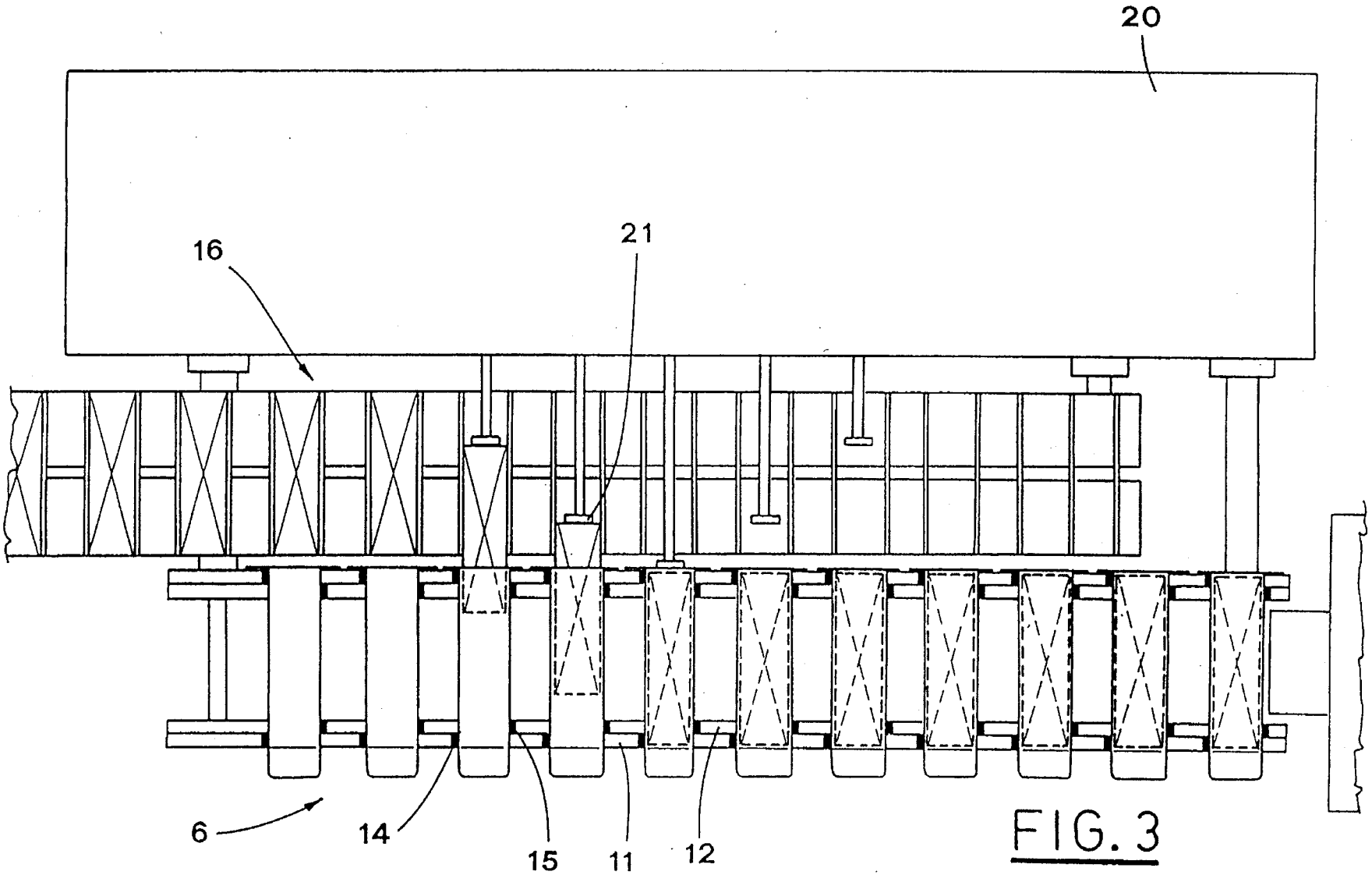
FIG. 3 shows a sectional view taken along the plane III—III of FIG. 1.

The line 16 for feeding articles 17 is situated between the fixed frame structure 20 and the packaging line 6 (see FIG. 3).

The fixed frame structure 20 includes also, thereinside, the operating means for pushers 21 that are designed, in packaging steps, to enter the drawers of the feeding line 16 so as to push the articles 17 into the cases 200.

In order to fulfil their task, the pushers 21 are made to move along a path, e.g. ring-like, that has a longitudinal section extending at the side of the line 16 for feeding the articles 17.

Obviously, the trailing speed, with which the pushers 21 are carried, is equal to the line movement speed.

Moreover, in correspondence with the above mentioned section, the pushers can be operated axially, i.e. transversally to the line 16, so as to push the articles 17 (see FIG. 3).

Moreover, means folding the lateral edges 2*a* of the blanks, formed e.g. by fixed stops of known type and not shown, are placed in correspondence with the packaging line 6, on the side facing the feeding line 16.

Figure 4:
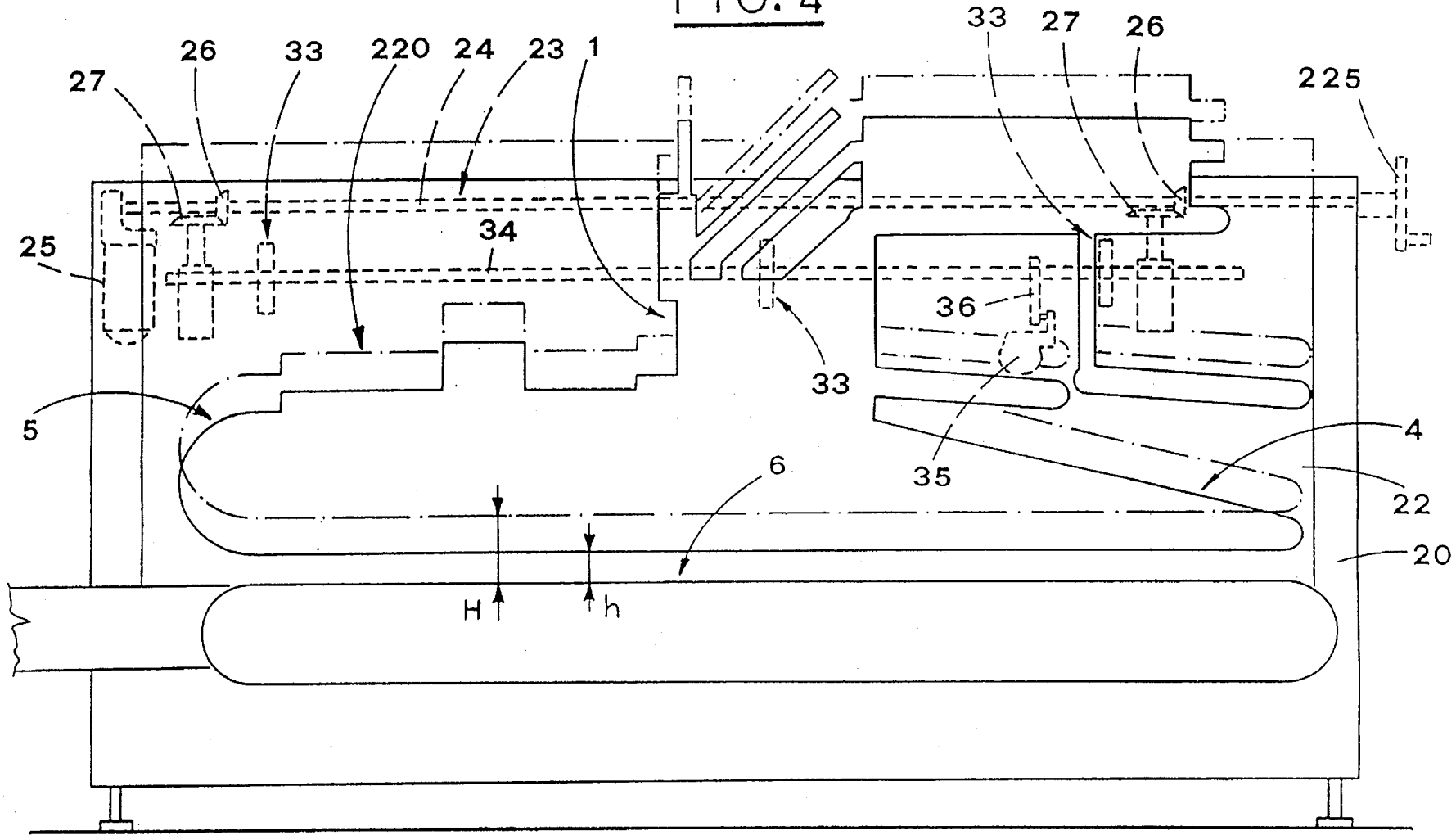
FIG. 4 shows a schematic side view of the machine, in which the cases height adjustment is emphasized.

As schematically shown in FIG. 4, the group formed by the withdrawal station 1, the feeding line 4 of the blanks 2 and the carton set up device 5, is supported by a vertical plate 22, constrained to a side of the fixed frame structure 20.

This plate 22 can be moved vertically, changing the distance between the lower run of the belts 8 and the belts 11, 12 of the packaging line 6 in accordance with the height of the cases 200.

In particular, the distance between the belts 8 and 11 is adjustable from a minimum height h to a maximum height H, in correspondence with a position of the above mentioned group indicated with the mixed dash line 220.

This adjustment is carried out by translation of the plate 22 provoked by means of a device 23 comprising a longitudinal bar 24, that is rotatably carried at the top of the fixed frame structure 20 and that can be driven by a gearmotor 25.

It is also possible to apply an ancillary hand-wheel, indicated with a broken line 225 in FIG. 4, to the bar 24.

Figure 5:
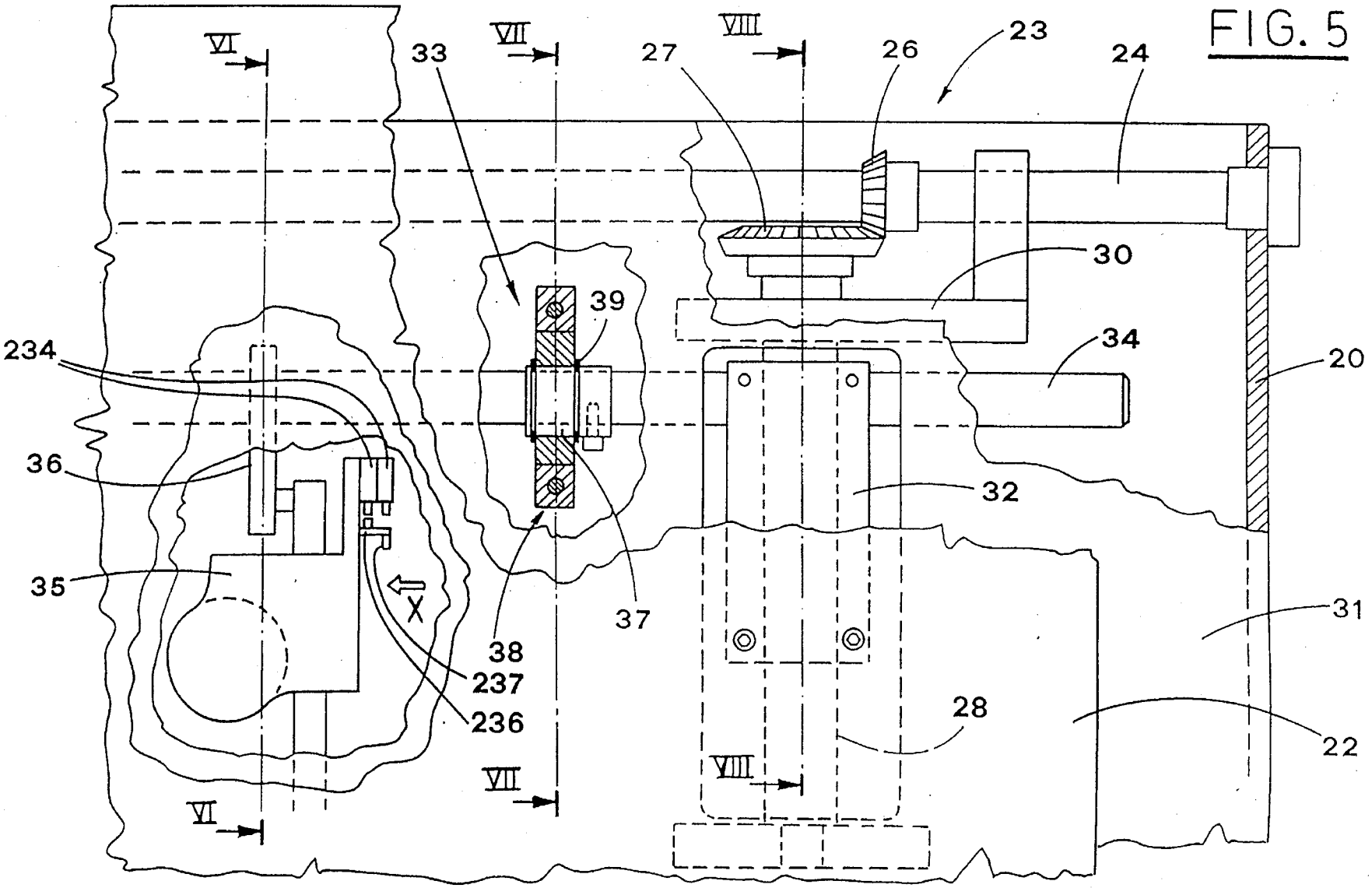
FIG. 5 shows a detailed, partially sectional view, of a part of the machine.
Figure 8:
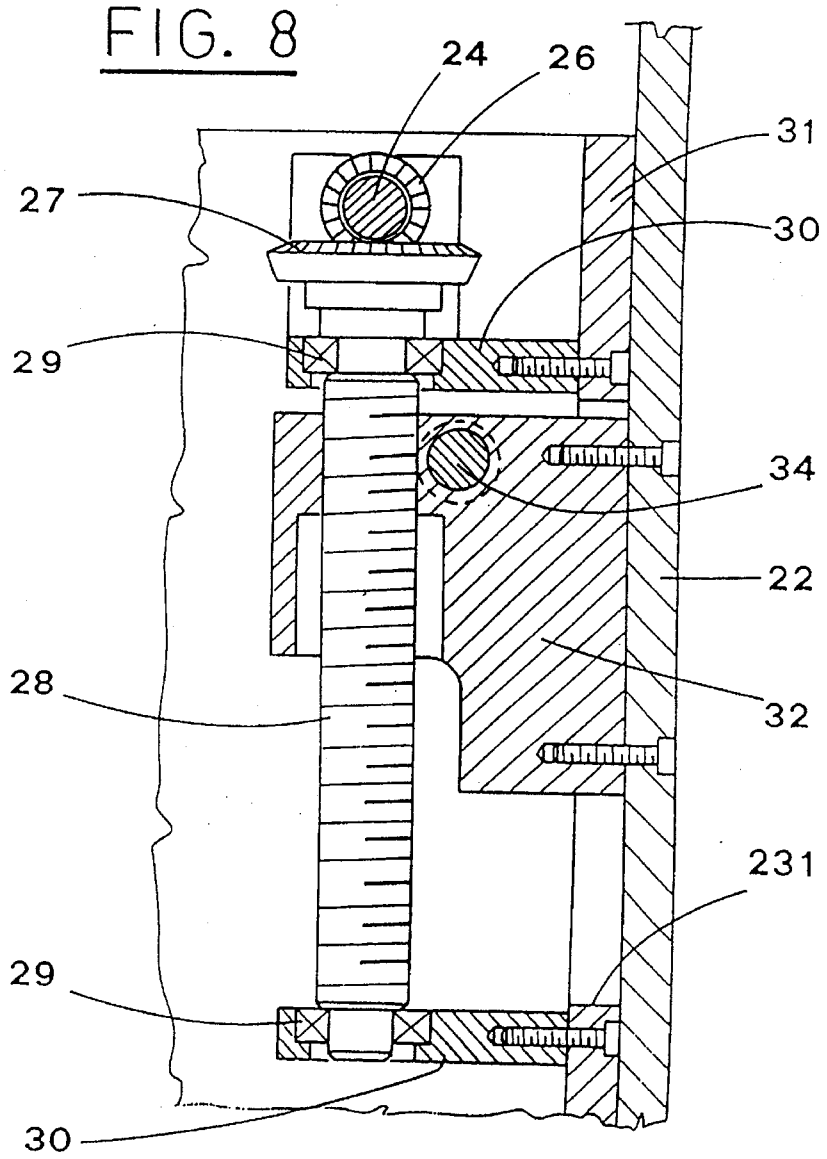
FIGS. 7 and 8 show sectional views taken along lines, respectively VII—VII and VIII—VIII of FIG. 5.

Near its opposite ends, the bar 24 has respective bevel gears 26 keyed thereonto, which gears mesh with respective bevel ring gears 27 keyed onto an end of screw means 28 (FIGS. 5 and 8).

These screw means 28 are rotatably supported, with vertical axis, by pairs of brackets 30 via rolling bearings 29.

The brackets 30 are integral with a wall 31 of the fixed frame structure 20, that supports the plate 22.

The screw means 28 are joined with respective nut screws made in support means 32 which passes through slots 231 of the wall 31 and are fastened to the plate 22 (see particularly FIG. 8).

The adjustment device 23 can be locked in the working position by means of a plurality of brakes means 33 arranged, suitably spaced apart, along a locking bar 34 that passes, with possibility to rotate, through support means 32, according to a longitudinal axis parallel to the bar 24.

In particular, the illustrated device herein illustrated has three brakes means 33.

Figure 6:
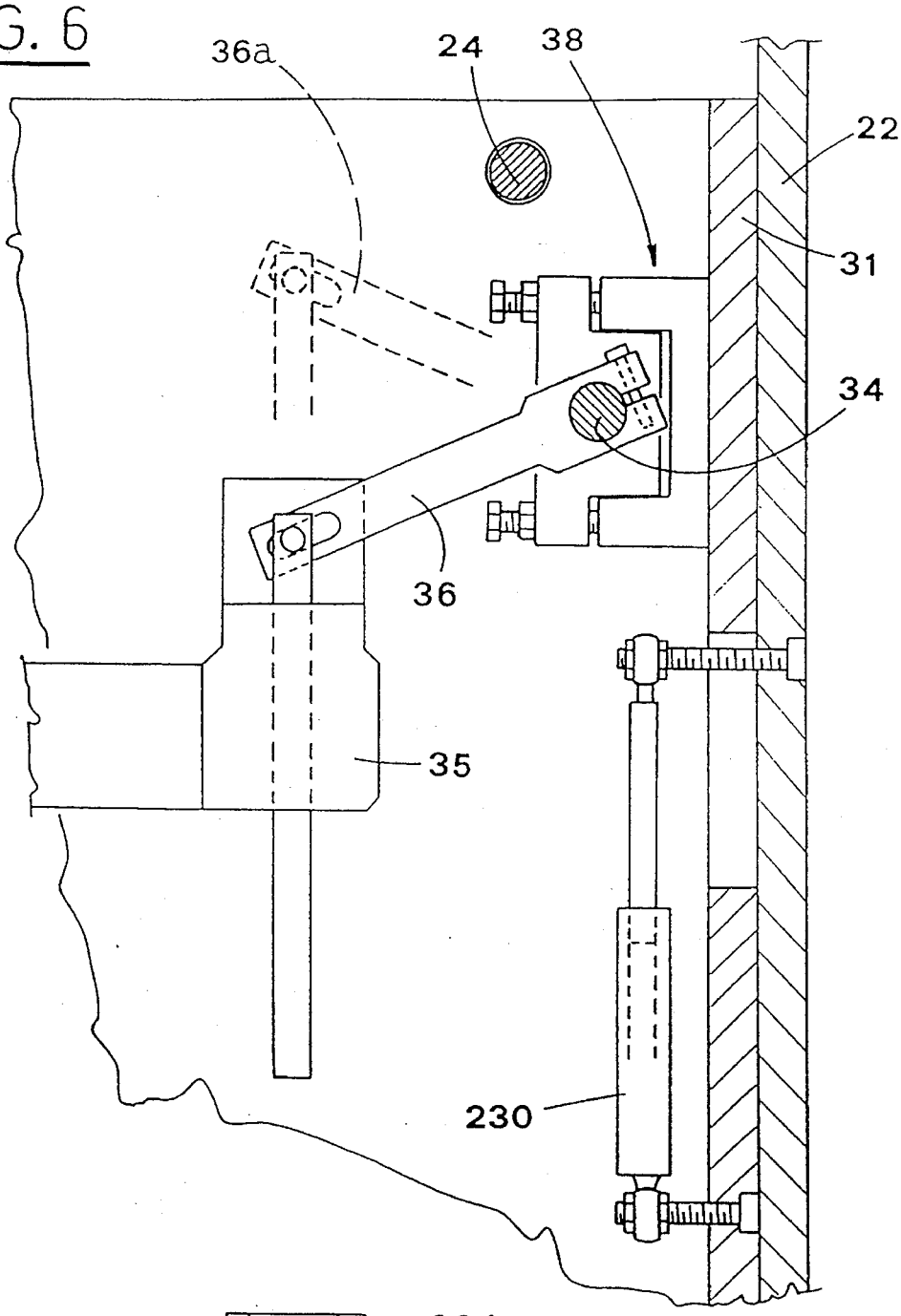
FIG. 6 shows a sectional view taken along line VI—VI of FIG. 5.

The locking bar 34 is controlled by an actuator member 35 that is designed to control angular alternative rotation of a lever 36 fastened transversely on the bar 34 (FIGS. 5 and 6).

Each brake means 33 features an eccentric bushing 37 fastened to the locking bar 34.

A block 38 is mounted on the eccentric bushing 37 near the wall 31.

The block 38 includes two parts 38*a*, 38*b* connected with each other by means of special screws 238 aimed at regulating the locking pressure.

Figure 7:
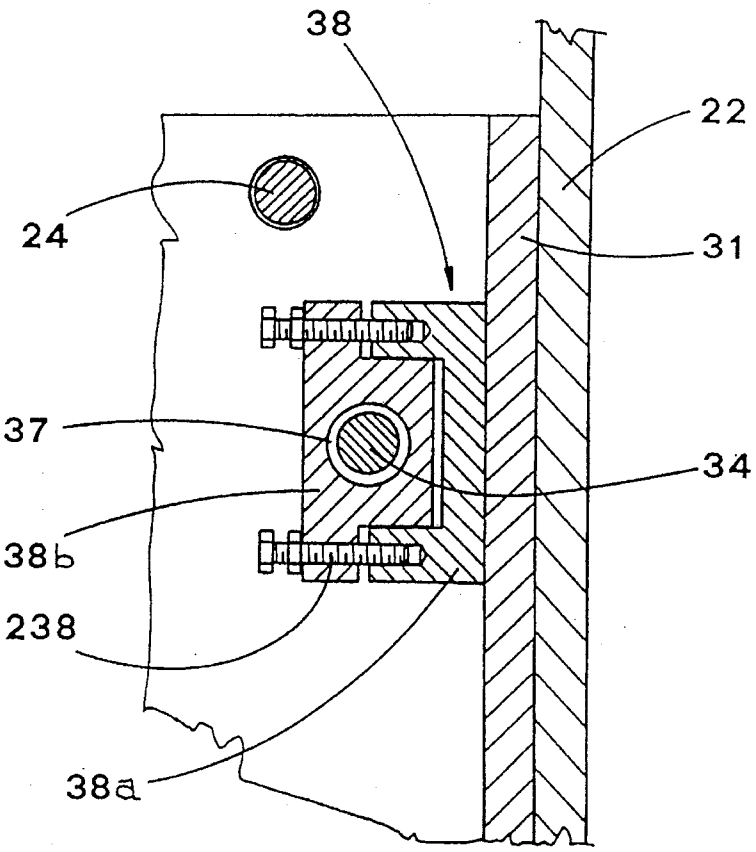

Opposite elastic rings 39 hold the block 38 on the eccentric bushing 38 (FIGS. 5, 7).

Therefore, by rotating the lever 36, as shown with broken line 36a in FIG. 6, the eccentric section of the bushing 37 is moved toward the wall 31 locking the block 38 thereto.

Figure 6A:
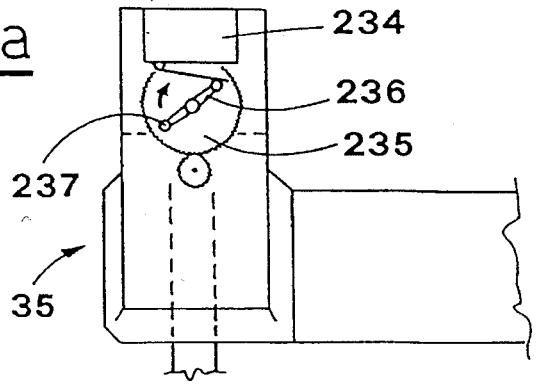
FIG. 6*a* shows a particular as seen from the side indicated with X in FIG. 5.

A gear wheel 235, aimed at driving a rocker 236 into rotation, is joined to the actuator member 35 (see particularly FIG. 6*a*).

On its ends, the rocker 236 features respective pins 237 protruding transversally on opposite sides and designed to operate relative microswitches 234 that control the extension of the movements imposed by the actuator member 35.

The adjustment device includes also a linear transducer 230, whose ends are bound to the plate 22 and to the wall 31, so as to control the amplitude of the plate 22 translation, for automatic size adjustment (FIG. 6).

Figure 9:
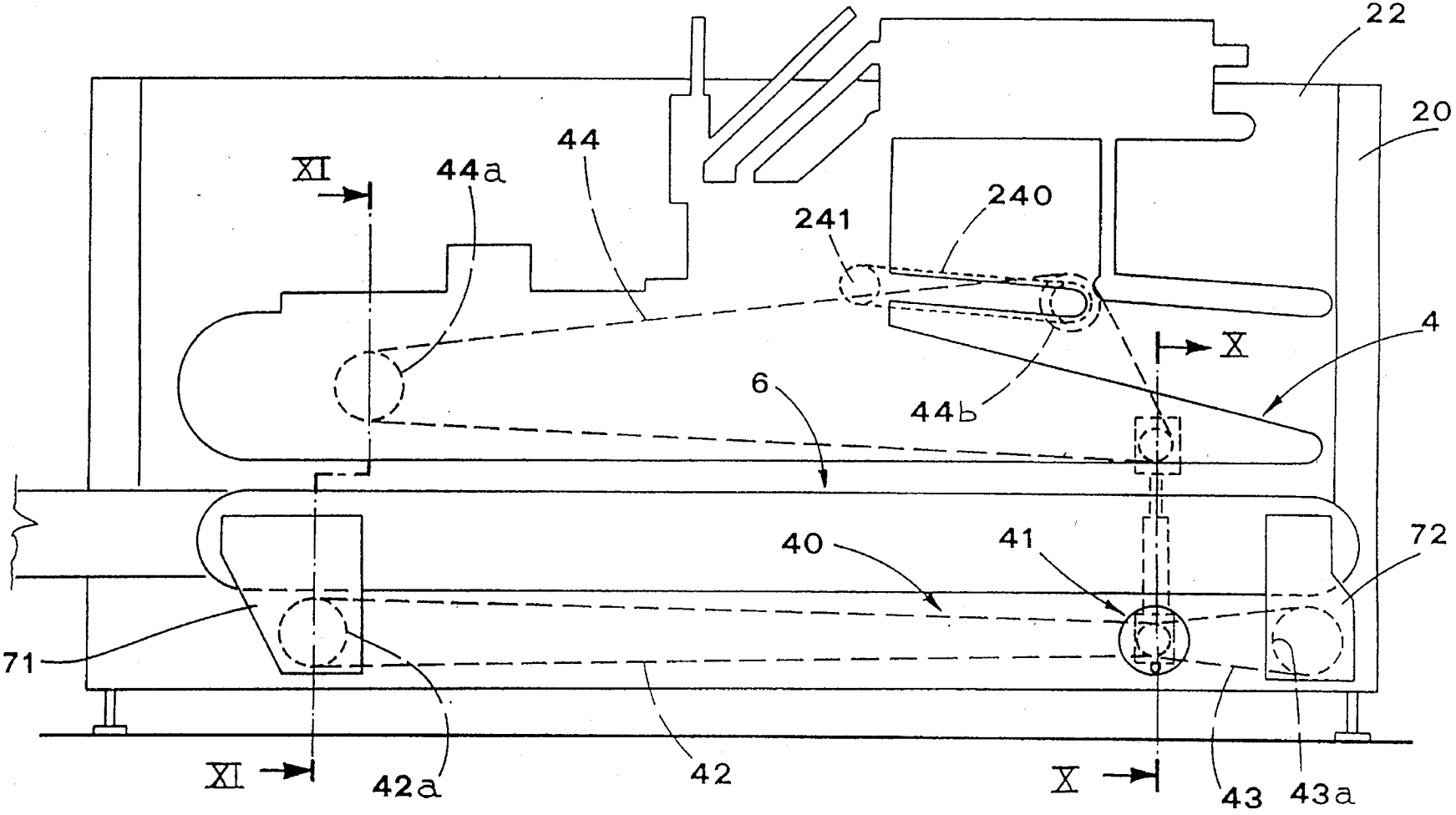
FIG. 9 shows a schematic side view of the machine, in which transversal size adjustment is emphasized.

The machine is provided with a device 40, shown schematically in FIG. 9, for adjusting the machine relative to the longitudinal size of the cases 200, i.e. in direction transversal to the above mentioned lines 4, 6 and 16.

The adjustment device 40 is operated by a centralized control element 41 situated below the packaging line 6.

The control element 41 is designed to operate a first and second flexible linking members 42, 43 that, form opposite sides, extend longitudinally to the packaging line 6.

Moreover, at the same time, the control element 41 send a command to the line 4 for feeding blanks 2, that is situated above, by means another linking member 44 that drives a transmission means 240.

The transmission means 240 controls the transversal adjustment of the magazine 3.

Figure 10:
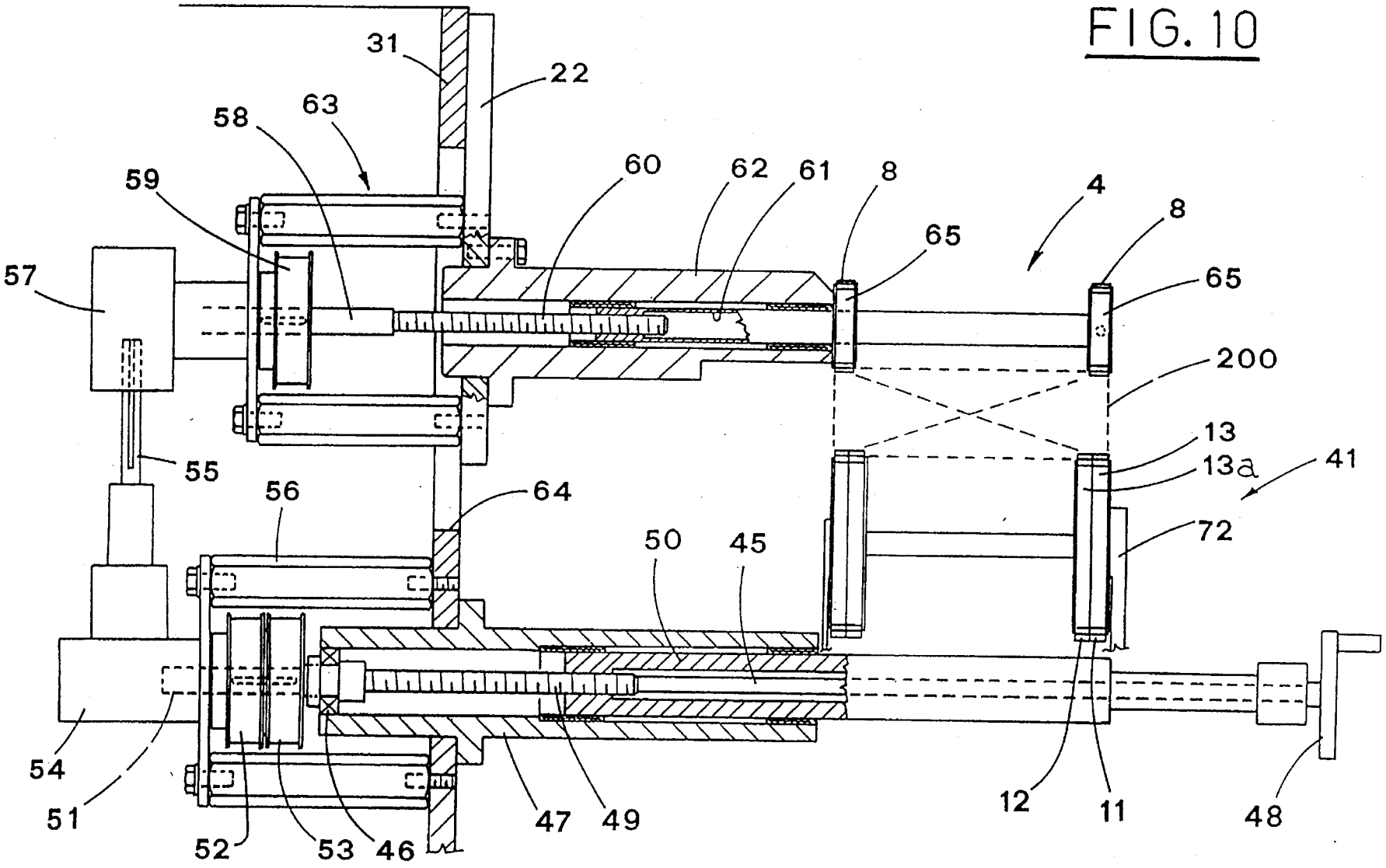
FIGS. 10 and 11 show sectional views taken along lines, respectively X—X and XI—XI of FIG. 9.

More precisely, the control element 41 of the adjustment device 40 has a bar 45 carried, with rotation possibility due to interposition of a rolling bearing 46, by a tube 47 according to an axis transversal to the machine, and operated by a handwheel 48 situated on its outer end (see FIG. 10).

The tube 47 is fastened to the wall 31 of the fixed frame structure 20.

The bar 45 has a threaded section 49 that is coupled with a corresponding screw nut formed by a tubular sleeve 50 guided inside the tube 47.

At the end that is turned towards the inner part of the fixed frame structure 20, the bar features a shaft 51 with a pair of pulleys 52, 53 keyed thereonto, the pulleys 52, 53 around which the above mentioned linking means 42, 43 are trained, are arranged side by side.

The end of the shaft 51 engages a transmission gearing member 54 supported by a frame 56 fixed to the wall 31 and designed to rotate a vertical shaft 55.

The vertical shaft 55 engages, axially slidingly, another transmission member 57 that operates another horizontal shaft 58 carrying, keyed thereonto, a pulley 59 around which a further linking member 44 is trained.

Therefore, driving the bar 45 into rotation, by means of the handwheel 48, causes simultaneous rotation of the pulleys 52, 53 and 59 that drives the linking means 42, 43, 44 which transmit the movement to respective pulleys 42*a*, 43*a*, and 44*a* indicated with sketched line in FIG. 9.

The linking 44 transmits movement, by a pulley 44*b*, also to the transmission member 240 that controls transversal adjustment of the magazine 3.

This transmission member 240 operates another pulley 241.

A threaded section 60, coupled with a correspondent screw nut formed by a tubular sleeve 61 guided inside a tube 62, extends from the shaft 58.

The tube 62 is fixed to the plate 22 according to a transversal axis.

A transmission member 57 is also fixed to the plate 22 has also fixed by means of a frame 63 that passes through a slot 654 made in the wall 31.

The plate 22 can move vertically, due to sliding coupling of the shaft 55 with the transmission member 57, so as to match the case height.

Two auxiliary toothed wheels 65 are mounted on the sleeve 61 and engage the toothed belts 8 of the feeding line 4.

More precisely, the outer auxiliary toothed wheel 65 is integral with the end of the sleeve 61 that can slide axially with respect to the opposite wheel 65.

A similar device provided with a sleeve 66 movable axially along a tube 67, operated by a screw coupling, not shown, is placed in correspondence with the pulley 44*a* that is moved by the linking 44 (FIG. 11).

The sleeve 66 is integral with a vertical plate 68, that rotatably carries, at its side, one of the pulleys 9, so as to move it transversally as shown with the broken line 209 in FIG. 11.

Similar devices provided with a sleeve 69 movable axially along a tube 70, moved by a related female threaded means, are situated in correspondence with the pulleys 42*a*, 43*a* on which the transmission belts 42 and 43 train around.

Respective plates 71, 72, rotatably carrying respective coupled pulleys 13, 13*a*, are integral with these sleeves 69 (see again FIG. 9).

Therefore, the translation of the sleeves 69 operated by the control member 41 makes the pulleys 13, 13*a* move, as shown with broken line 213 that indicates the minimum distance position of the pairs of belts 11, 12 of the packaging line 6.

Likewise, the translation of the sleeves 61, 66 activates corresponding movement of one of the belts 8 of the feeding line 4.

Obviously, it is possible to change the distance the above mentioned belts in relation to the blanks size by operating the control element 41.

Groups of blanks, indicated with 102 in FIG. 1, are fed to the magazine 3 of the withdrawal station 1 by a conveying belt 103.

The conveying belt 103, that is trained around pulleys 104, 104*a*, is situated over the feeding line 4 and longitudinally with respect thereto.

The groups of blanks 102 are guided laterally, between edges 156.

The magazine 3 is supported by a frame structure 106 that is linked in 108*a* to a couple of arms 107 which pivot on a pin 108 with respect to the fixed frame structure of the machine.

Moreover, the frame structure 106 is linked to a pair of driving arms 109 that, together with the above mentioned arms 107, form a hinge linked parallelogram.

Therefore, activation of the driving arms 109 in the position indicated with sketched line 109*a* in FIG. 1 causes corresponding rotation of the arms 107 that move to the position 107*a*.

Consequently, the frame that supports the magazine 3, is shifted to the raised position 3*a*.

In its upper part, the frame structure 106 carries the above mentioned belt conveyor means 103 that feeds the magazine 3 with groups of blanks.

It is to be pointed out that the axes of the pins 108, 108*a* of the oscillating arms 107 coincide with the axes of the pulleys 44*b*, 241 of the transmission member 240 that controls transversal adjustment of the magazine 3, so that this transmission member 240 does not limit movement of the frame structure 106.

The magazine 3 has vertical guides 116*a*, 116*b*, respectively fore and rear with respect to the moving direction of the feeding line 4, aimed at guiding the stack of blanks 2.

As will be explained in the following, these guides are movable so as to adjust the dimensions of the magazine 3 in accordance with different sizes of the blanks 2 used to set up the cartons.

Figure 12:
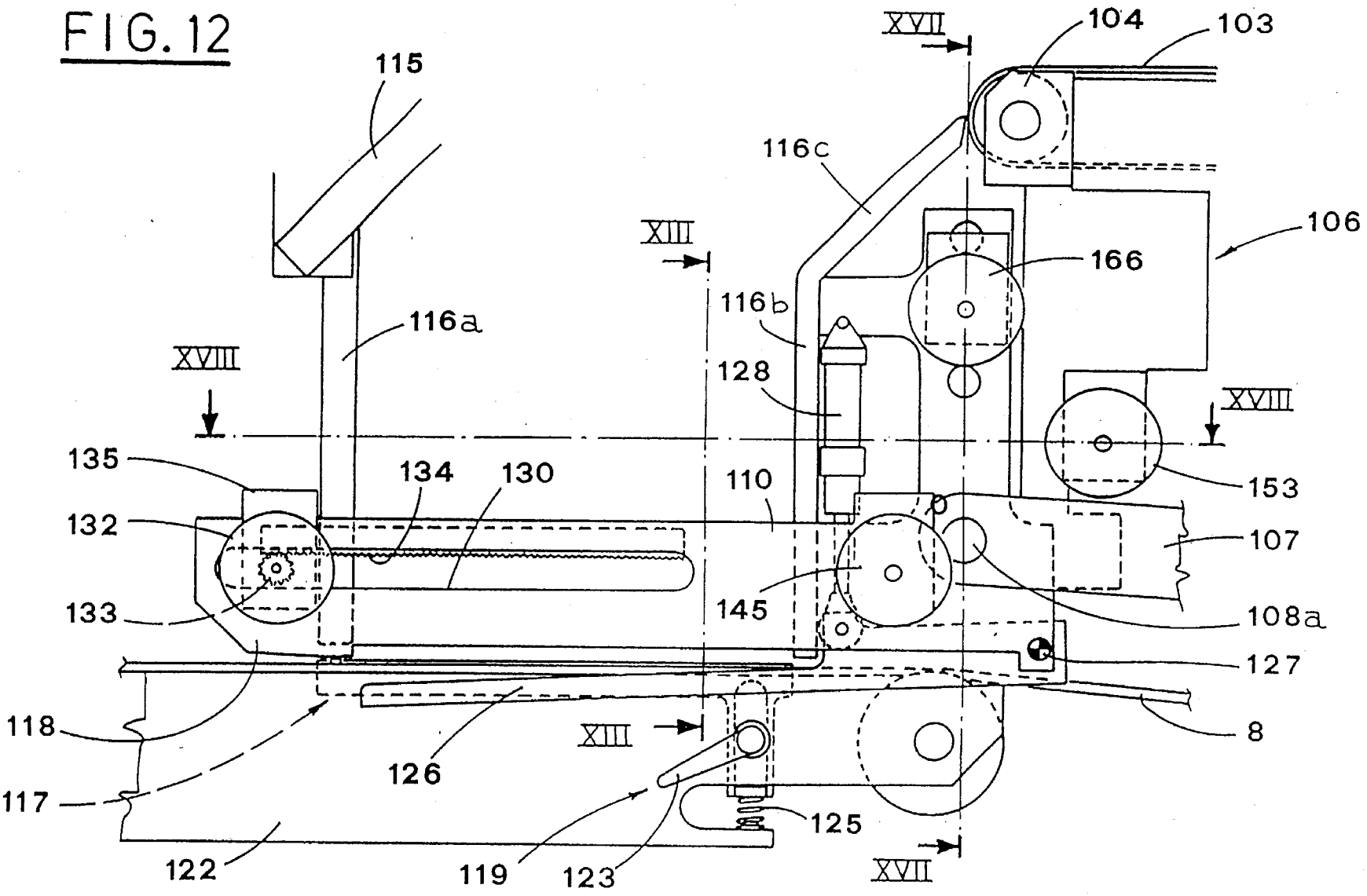
FIGS. 12 shows a schematic side view of the blanks withdrawal station.
Figure 13:
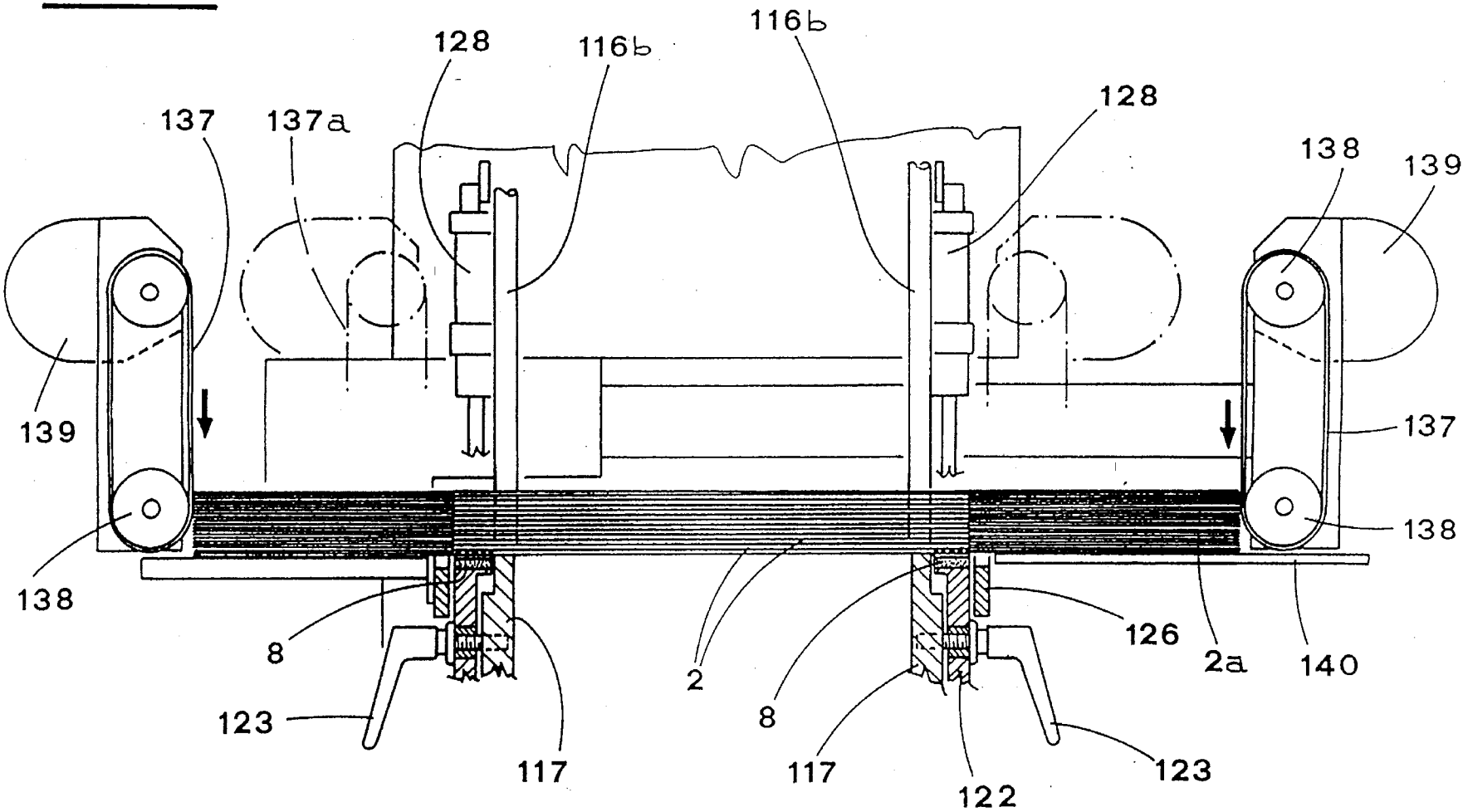
FIG. 13 shows a cross sectional view taken along line XIII—XIII of FIG. 12.

The upper guides sections 116*c* of the rear guides 116*b* are inclined and extend close to the feed belt conveyor 103 (see FIG. 12).

The inclined guide sections 116*c* are in fact tangential to the pulley 104, around which the belt conveyor 103 is trained.

In front of the inclined guide sections 116*c* there is located a guiding member 115, aimed at guiding the blanks 2.

It is possible to adjust the position of the guiding member 115 according to the size of the blanks.

Two bars 117 are placed below the magazine 3, parallel to the belts 8, and the stack of blanks 2 rests on the upper surfaces of the bars.

The resting plane, defined by the upper surface of the bars 117, is slightly upper than the conveying plane formed by the belts 8, but lower than the top of the lugs 10.

Figures 14, 14A, 14B:
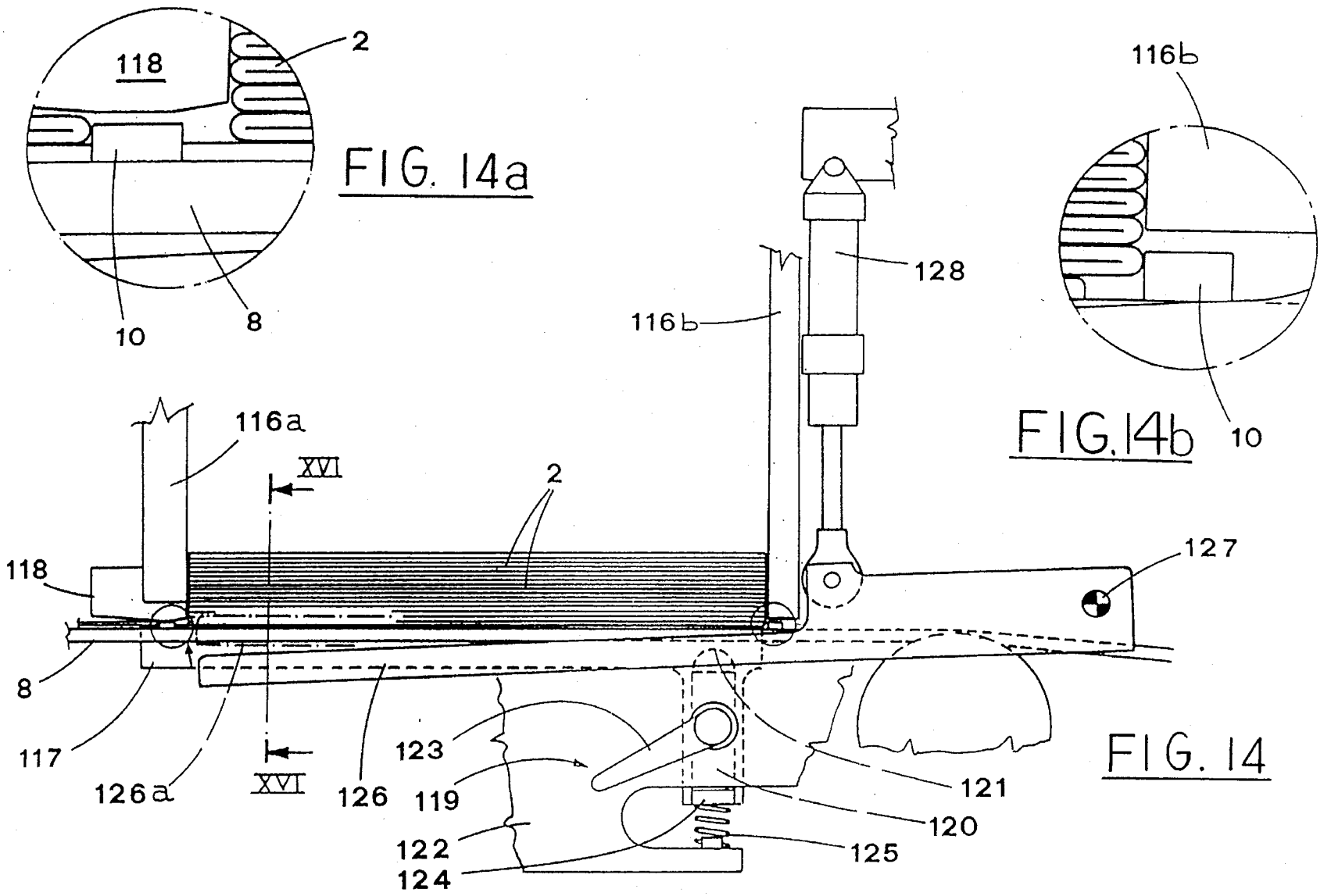
FIG. 14 shows a detailed side view, with enlarged particulars, of the above mentioned blanks withdrawal station.

Stop means 118, situated downstream of the magazine 3 and vertically adjustable, cooperate with the supporting bars 117 (see FIG. 14).

The vertical position of the bars 117 may be adjusted by a special adjusting element 119, operated manually.

This adjusting element 19 includes a slide 120 sliding in a correspondent vertical slot 121 made in the lower prominence o each bar 117; the slide 120 can be locked to a correspondent wall 22, bound to the magazine frame, by means of a locking lever 123.

It will be noted that, in its upper part, the wall 122 supports and guides a respective toothed belt 8, in (its section underlying the withdrawal station 1) correspondence with the withdrawal station 1.

In its lower part, the slide 120 features a plate 124, on which a helical spring 125 acts, along the same vertical axis.

Figure 15B:
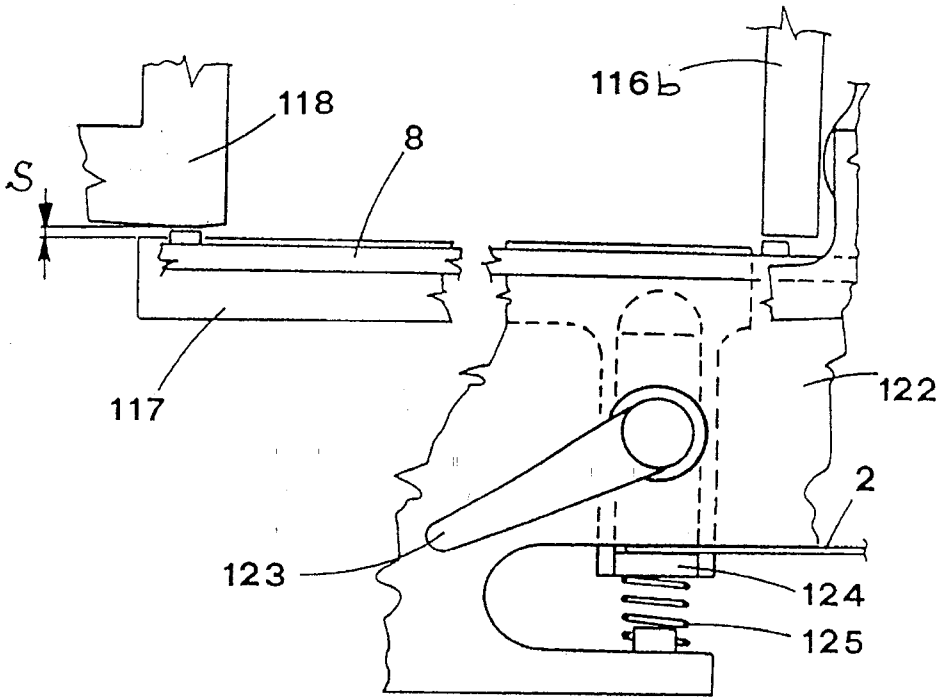
FIGS. 15*a* and 15*b* show a particular of the withdrawal station shown in FIG. 14, respectively while being adjusted and in operation.

Between the supporting bars 117 and the stop means 118, there is formed a passage S, as wide as the passage between the plate 124 and the lower edge of the wall 122, and substantially equal to the thickness of a flattened blank 2, when the device is set into operation (see FIG. 15*b*).

Figure 15A:
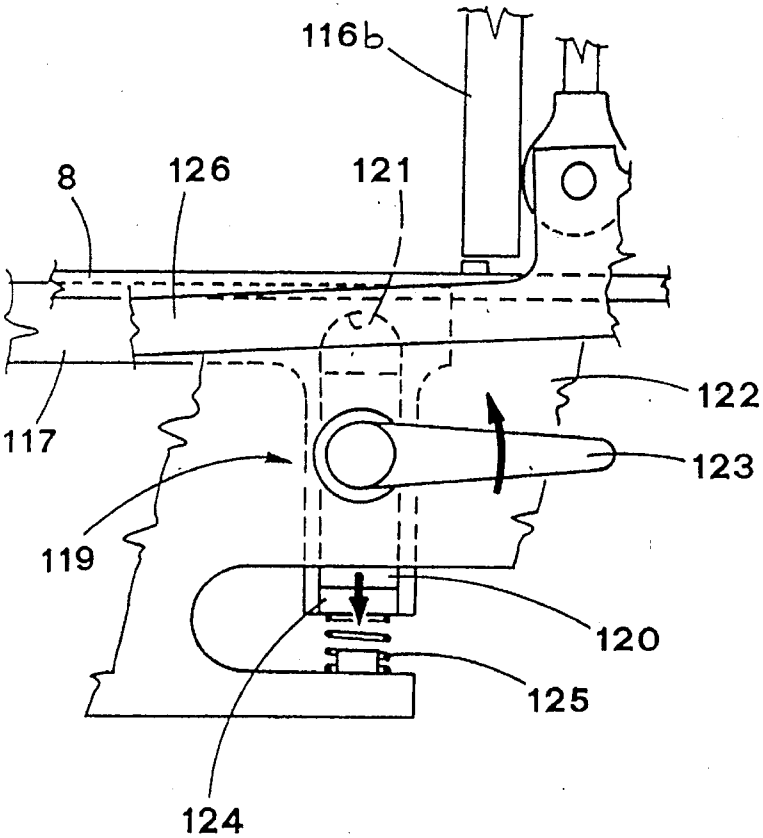

The width of the passage S can be adjusted in relation to the thickness of the blanks 2, by unlocking the locking lever 123 and moving downward the slide 120, against the spring 125, as seen in FIG. 15*a*.

To carry out the adjustment of the passage S, a blank 2 is introduced between the plate 124 and the lower edge of the wall 122 so as to clasp elastically the blank, and the slide is locked in this position (see FIG. 15*b*).

The stop means 118 can be mounted with possibility of oscillation against related elastic means, so as to prevent the blanks from jamming during withdrawal and to facilitate release thereof.

Two rockers 126, arranged side by side, are pivoted to the frame 106 by means of a pin 127 transversal to the feeding line 4.

The rockers 126 extend under the magazine 3 and can oscillate.

Jacks 128, bound to the frame 106, make the rockers move between a lowered position, in which the device operates in normal condition, and a raised position, that is shown partially by the sketched line 126*a* in FIG. 14.

When they are in the lowered position, the rockers 126 do not interfere with the belts 8 that withdraw and convey the blanks (see FIG. 16*a*).

In the raised position 126*a*, the rockers 126 raise the stack of blanks 2 inside the magazine 3 preventing the blanks from being withdrawn by the belts 8 (see FIG. 16*b*).

If the blank size is to be changed, it is possible to adjust the magazine 3 size by suitably changing the position of the angular guides 116*a*, 116*b*.

Figure 18:
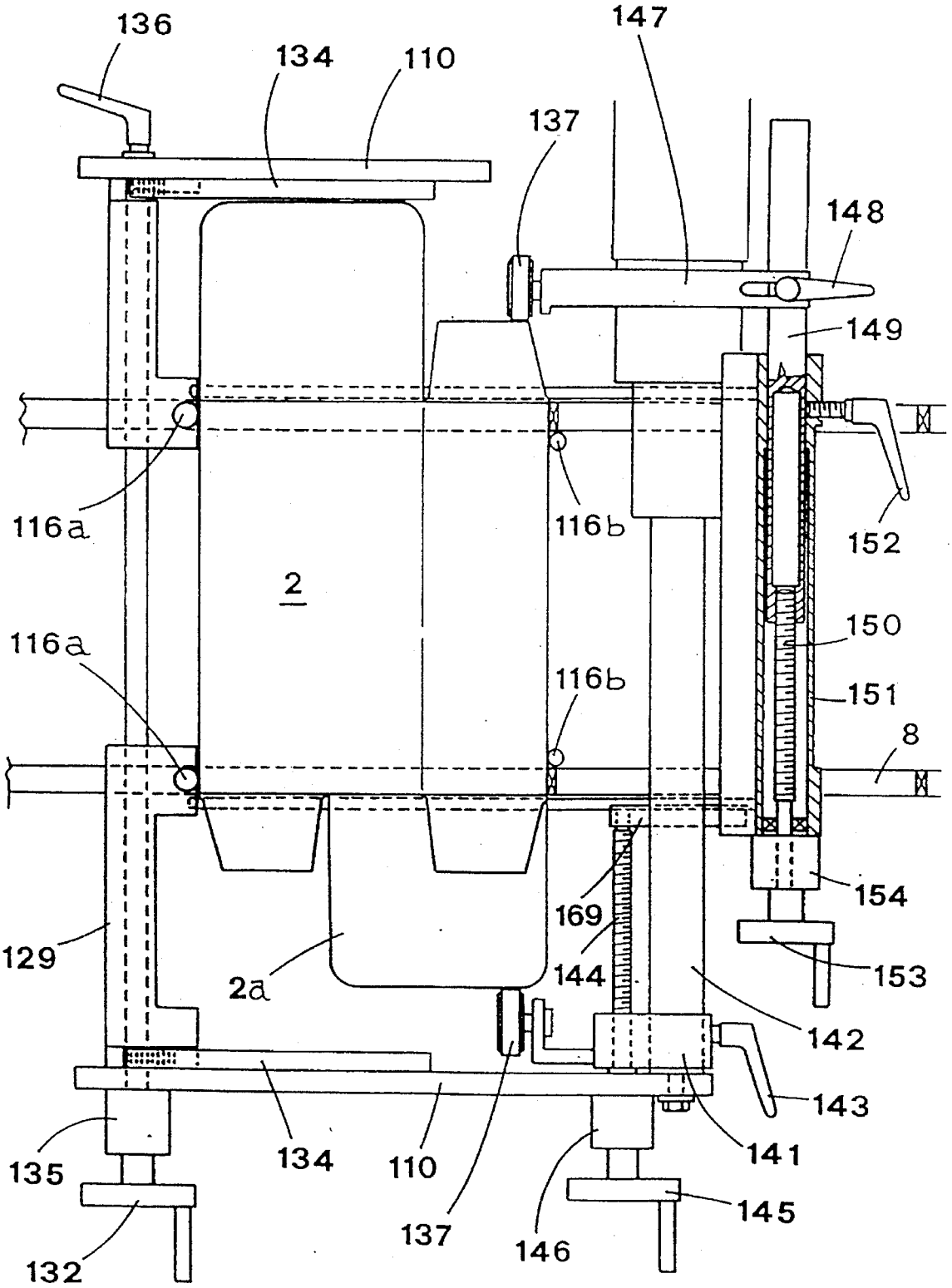
FIG. 18 shows a sectional view taken along line XVIII—XVIII of FIG. 12.

In order to change the magazine 3 longitudinal dimension, the fore guides 116*a* are supported by a carriage 129 (FIG. 18), that moves along the feeding line 4 through suitable slotted guides 130 made in correspondent sides 110 of the frame 106 that supports the magazine 3 (see FIGS. 12 and 18).

The carriage 129 also supports the stop means 118 as well as another pair of stop means 131 (see FIG. 1), aimed at acting on the blanks 2 from the top, downstream of the withdrawal station 1; preferably, the stop means 131 are formed by special brushes.

The carriage 129 is operated by a handwheel 132 that controls rotation of a sprocket gear 133 having horizontal axis and crossing the feeding line 4 from side to side.

On its ends, the sprocket gear 133 is in meshing engagement with a couple of racks 134 longitudinal to the feeding line 4 and integral with the supporting frame structure.

A suitable digital indicator 135 is connected with the handwheel 132 so that it is possible to check the displacement of the carriage 129, and consequently the adjustment position.

The carriage 129 can be locked manually by means of a locking lever 136.

In order to change the transversal dimension of the magazine 3, at least one of the guides 116*a*, 116*b* is moved transversally to the line 4, so as to change the distance between the same line and the symmetrical guides.

Obviously, it is necessary to move at the same time also the group supporting the belt 8 and providing adjustment for the means associated thereto.

Figure 17A:
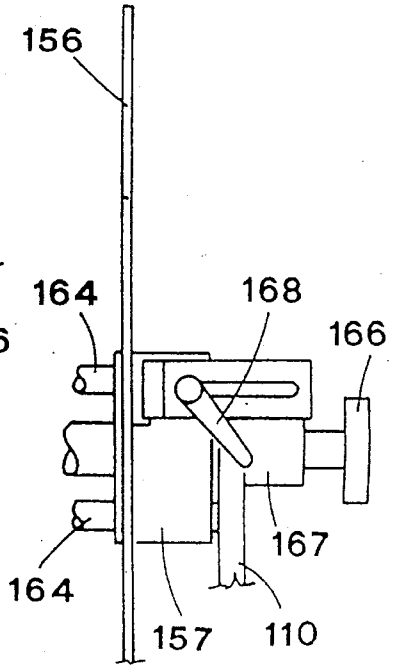
FIG. 17*a* shows a particular as seen in FIG. 17.
Figure 17:
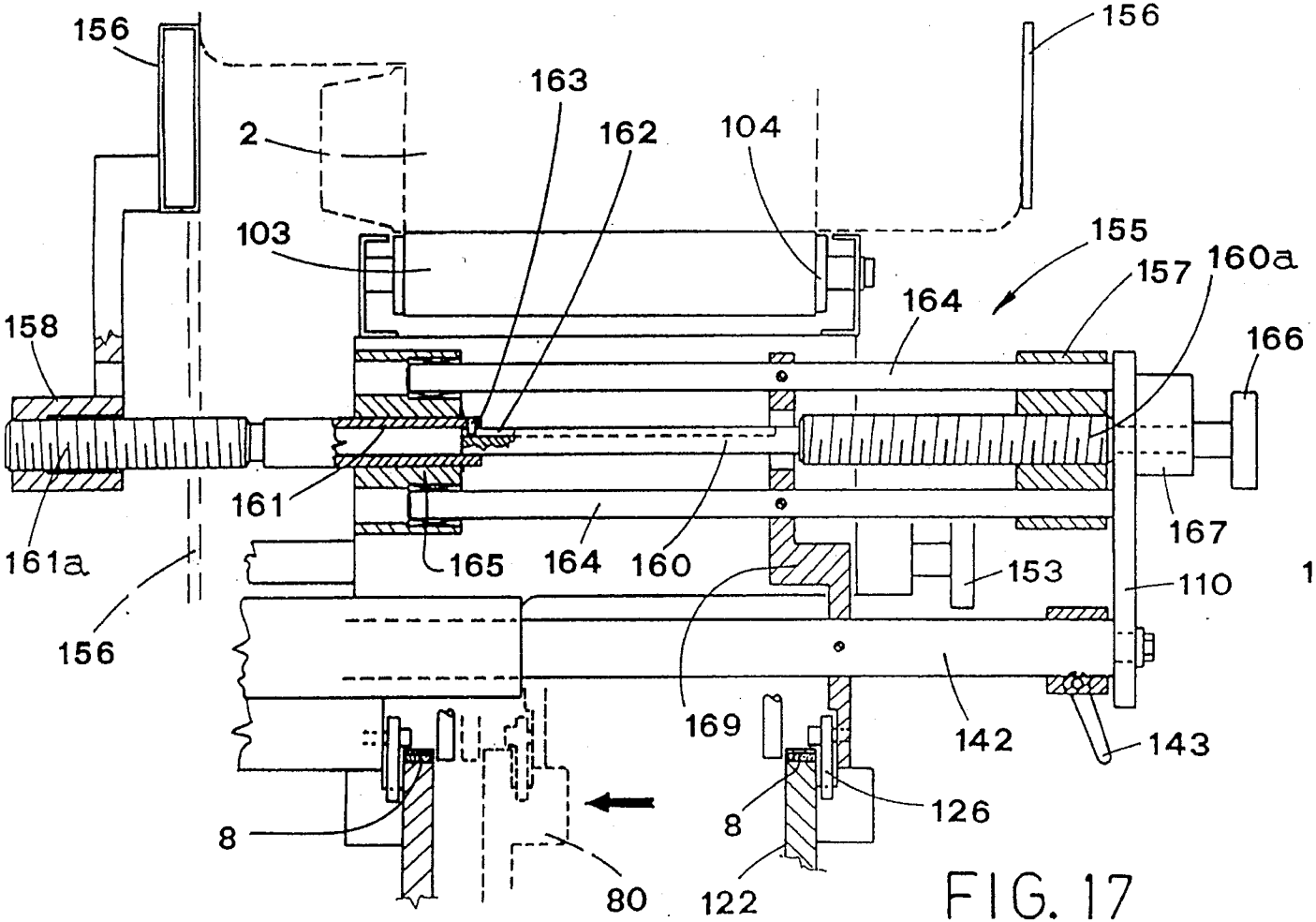
FIG. 17 shows a sectional view taken along line XVII—XVII of FIG. 12.

In FIG. 17 the broken line 80 indicates the position of the minimum reciprocal distance assumed by the above mentioned group.

These movements are operated by centralised means operated by the transmission 240 (FIG. 9).

The magazine 3 is equipped also with a pair of vertical belts 137, situated on the opposite sides of the feeding line 4 and facing each other.

The said belts 137 are designed to hold the side flaps 2*a* of the blanks 2.

The belts 137 are trained around respective pairs of pulleys 138 and are driven by a gearmotor 139, so as to push downward the edges of the side flaps 2*a* until they touch a rest plane 140.

It is possible to adjust the belts 137 transversally to the line 4, independently from the guides 116*a*, 116*b* and from each other, in accordance with the blanks 2 size, as indicated with the broken line 137*a* in FIG. 4.

In order to allow adjustment of the belts 137, the first of them is supported by a slide block 141, mounted slidably on a horizontal shaft 142 carried by the frame 106 and transversal to the feeding line 4.

The slide block 141 can be locked manually by means of a respective locking lever 143.

The slide block 141 movements are controlled by a threaded shaft 144 that can be driven to rotate about an axis parallel to the shaft 142, by a handwheel 145 connected with a special digital indicator 146 aimed at allowing check of the adjustment position.

The threaded shaft 144 is in meshing engagement with a correspondent female thread made in the slide block 141.

The second belt 137 is carried by a support 147 that can be locked to a tubular shaft 149 by means of a related locking means 148.

The tubular shaft 149 features an internal threaded portion with which a threaded shaft 150 is engaged.

The threaded shaft 150 rotates in coaxial relation with a sleeve 151 inside which the same shaft 149 is inserted.

The shaft 149 can be locked to the sleeve 151 by means of another locking lever 152.

The screw shaft 150 can be rotated by a handwheel 153 connected with a relative digital indicator 154.

The position of the slide block 141 and the shaft 149, that support the belts 137, can be changed by operating the handwheels 145, 153.

At the back of the magazine 3, there is a group 155 aimed at adjusting symmetrically the position of a pair of vertical side walls 156 extending in the upper part of the magazine and having the task of containing the blanks 2 (see FIGS. 1, 17 and 17*a*).

The walls 156 are supported by respective sliding blocks 157, 158 that feature respective internal threads which are in screw engagement with threaded portions 160*a*, 161*a* respectively made on a shaft 160 and on a tubular shaft 161 which are in coaxial relation.

The shaft 160 is inserted telescopically inside the tubular shaft 161 and has a longitudinal groove 162 engaged by a pin 163 fixed to the same tubular shaft 161, so as to maintain mutual connection during rotation.

The slide block 157 is slidably set on a pair of rods 164 bound to the frame 106 and sliding axially with respect to a bushing 165 that is set between the frame 106 and the tubular shaft 161 that is in this way rotatably supported.

The telescopical shafts 160, 161 can be rotated by a handwheel 166 connected to a suitable digital indicator 167, and can be locked by a related locking lever 168.

The mutual position of the slide blocks 157, 158 supporting the side walls 156 can be changed by rotating the handwheel 166.

The shaft 142 and the rods 164 are bound to a plate 169 that is part of the above mentioned group for supporting the belt 8, that can be moved transversally, and adjusting the means associated thereto.

In particular, a rocker 126 is pivoted to the plate 169 for raising the blanks 2 stack inside the magazine 3.

Therefore, transversal movement of the above mentioned group results in a similar movement of the shaft 142 and rods 164, and consequently, of the slide blocks 141, 157 carrying respectively, one of the belts 137 and one of the side walls 156.

As shown in a detailed way in FIGS. 20–23, the withdrawal station 5 is equipped with a rotary drum 500 provided with a plurality of gripping means 518 which include suction cups, designed to grip one wall panel of each flat folded cases 2 advancing along the feeding line 4.

The gripping means 518, equipped respectively with a pair of suction cups 519, are mounted in pairs on respective shafts 520 parallel to the axis of the driving shaft 521 of the pulleys 9, and angularly equispaced with respect to one another.

The pairs of suction cups 519 are carried by respective arms 522 that extend radially from the shafts 520 adjacent to the pulleys 9.

In particular, the arms 522 situated close to the ends of the shafts 520 and to the pulley 9 are fixedly joined to the shafts 520, while the other arm 522 is slidingly bound to the shafts 520 by known means, which are not shown, so that they can rotate therewith.

The arms 522 are axially moved in synchrony with the adjacent pulley 9.

In a working position, the suction cups 519 of the gripping means 518 face a pair of suction cups 523, driven by a crank mechanism 524 situated substantially at the outlet of the blanks 2 from the line 4, over the pulleys 9.

The crank mechanism features a supporting bar 525 for each suction cup 523, having opposite sides articulated to two cranks 526 which rotate about axes parallel to the axis of the driving shaft 521.

Figure 21A:
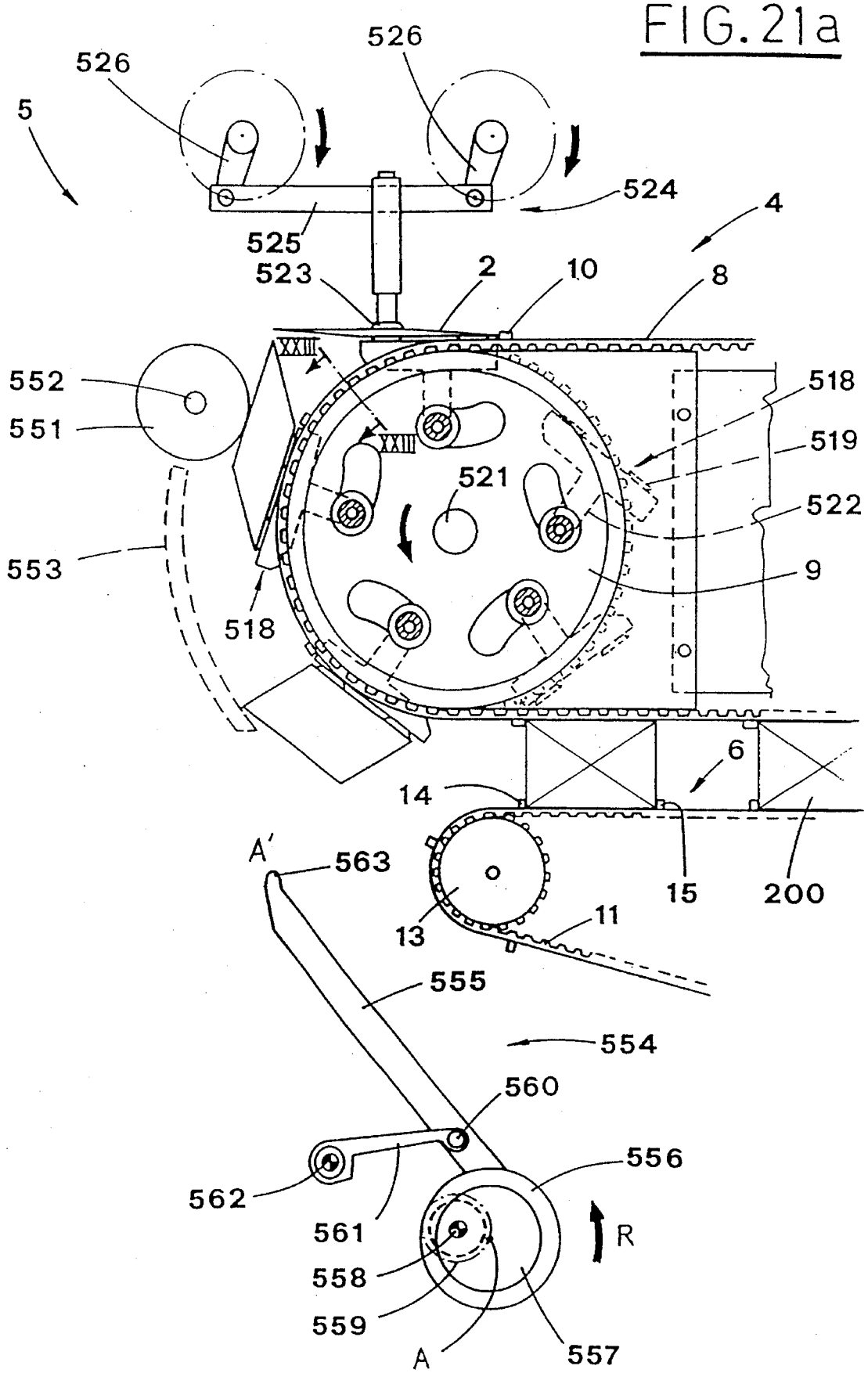
FIG. 21*a* shows a sectional view taken along line XXI—XXI of FIG. 20.
Figure 21B:
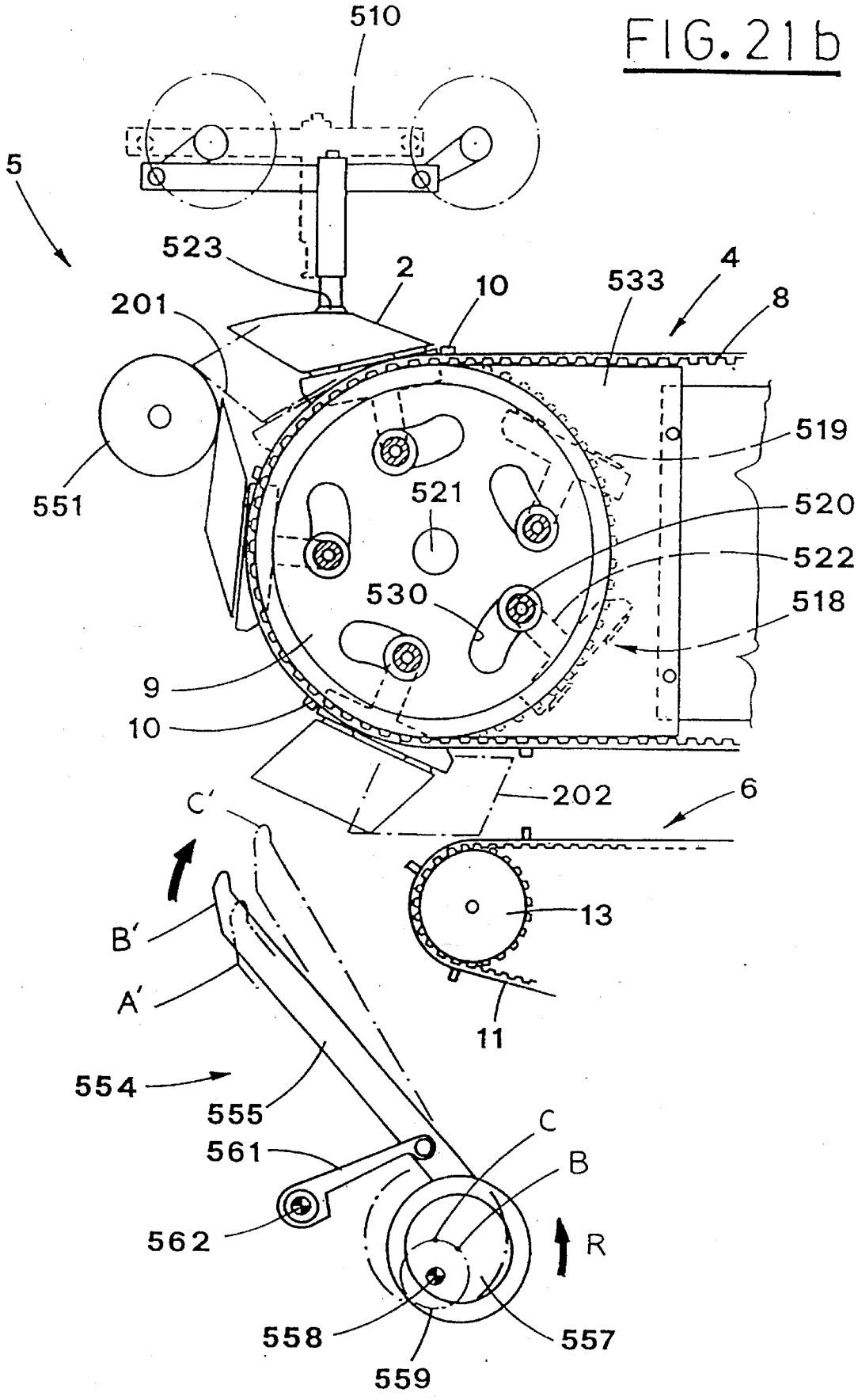
FIGS. 21*b*, 21*c* and 21*d* show the same view as FIG. 21*a*, in different working steps.

Therefore, the bar 525 moves on a longitudinal plane, maintaining its horizontal attitude, as broken line 510 shows in FIG. 21*b*.

The shafts 520 of the suction cups 519 protrude from the outer pulley 9 and are operated by a device 529 acting on related ends of the shafts.

The outer pulley 9 has arc-like slots 530 through which the shafts 520 pass, the convexity of the slots facing the center of the pulley (FIG. 21*b*).

As better seen in the enlarged particular in FIG. 23, a ring-like protrusion 532 made on a surface of a plate 533 fixed to the frame of the device (FIG. 21*b*), supports rotatably the pulley 9, in such a manner that it can rotate by means of a rolling bearing 531.

The pulley is fastened, by a screw 534, to a ring 535, and the bearing 531 is clamped between the ring 535 and a spacer 536.

The shafts 520 are carried, in such a manner that they can oscillate, by respective cranks 537 bound transversally to respective pins 538 (FIG. 20).

The rotating pins 538 are carried by a drum 539 of the operating device 529 mounted in cantilevered fashion on the driving shaft 521.

In particular, the pins 538 are supported by rolling bearings 540 in such a way that they pass through cross holes 541 made along the periphery of the drum 539 and regularly spaced apart from one another.

Sleeves 542 are mounted on the pins 538 and feature suitable elastic seals that make a tight seal on the inner surface of the holes 541.

Rocking levers 543 are integral with the pins 538 at the side opposite to the crank 537.

The rocking levers 543 carry idling rollers 544 that run in a ring-like cam 545 made on a surface of a plate 546 integral with the frame (FIG. 22).

On the side turned outward, the plate 546 is covered by a protective case 547.

Known suction means, aimed at operating the suction cups 519 by special ducts, are connected to the operating device 529.

In particular, the suction cups 519, located close to the internal pulley 9, communicate with a duct 548 made along the shafts 520, arms 522, cranks 537 and pins 538.

This duct 548 opens in the holes 541 of the drum 539 that communicate with ducts 549 of the drum 539, connected with the above mentioned suction means (FIG. 20).

The suction cups situated close to the outer pulley 9 are instead connected with flexible pipes 550 in communication with the ducts 548.

Downstream of the section of the device in which the blanks 2 are gripped by the suction cups 519, there is at least one roller 551 rotating about an axis 552 and aimed at improving opening of the blanks 2 (FIG. 21*a*).

In fact, the roller 551 strikes a fore corner of the blank being opened, so as to fold backwards the related wall panel and subsequently yield the blank, as will be described in detail in the following.

Position of the roller 551 can be suitably adjusted in accordance with the dimensions of the cases to be opened.

An arc-like striker 553 can be located downstream of the yielding roller 551 and at a side of the rotating member, in a position that can be adjusted (FIG. 21*a*).

The task of the striker 553 is to prevent the blank 2 from returning to the nearly folded position because of elastic reaction of the sheet material.

Alternately, the only yielding roller 551 is provided, situated near the zone of feeding the blanks to the packaging line 6.

A pusher blade 555 extends from a ring-like head 556 mounted, in such a way that it can rotate, on an eccentric member 557 integral with the driving shaft 558.

Line 559 indicates the path of the center A of the eccentric member 557 that moves when the driving shaft 558 rotates (FIG. 21*a*).

A connection rod 561 pivoted to the fixed frame by means of a gudgeon 562 is articulated to the pusher blade 555.

The shaft 558 and the gudgeon 568 have the axis horizontal and transverse to the packaging line 6.

Operation of the described device is now explained, beginning after that the flat folded blank 2 has been withdrawn from the magazine 3.

The bars 117 support the stack of blanks 2 inside the magazine 3 (FIG. 14).

Below the blanks stack, there are the belts 8, with the lugs 10 protruding upward beyond the resting plane defined by the upper surfaces of the bars 117.

Therefore, passing below the magazine 3, each pair of lugs 10 engages the rear edge of the lowermost blank 2.

The blank 2 is withdrawn from the magazine 3 since it can pass through the passage defined by the supporting bars 117 and the stop means 118.

The upper blanks of the stack are prevented from being withdrawn from the magazine 3 by the stop means 118 that hold them at the fore edge, as clearly seen in FIG. 14.

After leaving the magazine 3, no more supported by the bars 117, the balk 2 lays down on the belts 8, whose conveying surface is slightly lower than the resting surface of the bars 117.

In practice, the withdrawn blank 2 is housed in the space defined between two subsequent pairs of lugs 10 and is stopped by rear pair of lugs 10.

At the top of the pulleys 9, the bottom of the flattened blank 2 is gripped by pairs of suction cups 519 of the gripping means 518, as seen in FIG. 21*a*.

The blank 2 is held by the suction cups 519, suitably activated, that transfer it to the packaging line 6 below.

During the transferring step, the blank 2 is opened.

It will be noted that during the transferring step the suction cups 519 are situated on a plane substantially tangential to the rotating member with pulleys 9.

In order to facilitate the gripping of the blank 2 to be transferred, the arms 522 carrying the suction cups 519 are rotated around respective pins 538 so as to incline the suction cups 519 toward the feeding line 4 (FIG. 21*b*).

Therefore, the arms 522 move progressively in opposite direction, so as to cause the suction cups 519 to lap, on a tangential plane, the flat folded blanks fed along the feeding line 4.

The arms 522 are rotated by the rocking levers 543 that engage the fixed cam 545 during rotation of the device 529 (FIG. 22).

At the same time, the blanks 2 are gripped at the other side by other suction cups 523 driven by the crank mechanism 524.

As a result of the rotation of the member with pulleys 9 and of the operation of the crank mechanism 524, the suction cups 519, 523 move ones with respect to others so that the adjacent wall panels of the blank 2 are opened (FIG. 21*b*).

The blank 2, partially erected, is released by the suction cups 523 by stopping their suction action.

Opening of the blank 2 is completed by the roller 551 that also helps the blank 2 to engage the striker 553, if present.

As seen if FIG. 21*b*, the roller 551 strikes the fore corner of the blank 2 held by the suction cups 519; for the sake of clarity, the case has been indicated with mixed sketched line 201.

Therefore, the roller 551 folds backwards the related fore wall panel of the blank 2 causing its yielding.

As a result, the blank does not return elastically to the almost flat folded position, after it has been released by the suction cups 523.

When located at the bottom of the pulleys 9, the suction cups 519 are placed on a plane longitudinal to the packaging line 6.

The pusher blade 555, operated in suitable phase relation with introduction of the blank between the upper belts 8 and the lower belts 11, 12 of the packaging line 6, acts on the back of the blank 2.

More precisely, the driving shaft 558 while rotating in the direction indicated by arrow R, causes rotation of the eccentric member 557, whose center follows the path 559.

The blade 555 takes the position A' when the center of the eccentric member 557 is in the point A of the path 559 (FIG. 21*a*).

Rotation of the eccentric member 557 causes oscillation of the pusher blade 555, as seen in FIG. 21*b*, where B' and C' indicate the positions of the blade 555 which correspond with the positions B and C of the eccentric member 557 along the path 559, beginning from the position A' of the blade.

Oscillation of the blade 555 follows an arcuated path, as seen from the positions D', E' and F' of FIG. 2*c* corresponding with the positions D, E and F of the eccentric member 557 along the path 559.

In this step the blank, partially inserted between the upper belts 8 and the lower belts 11, 12 of the packaging line 6, is pushed by the pusher blade 555.

The pusher blade position at the beginning of pushing is indicated by sketched line 202.

Figure 21D:
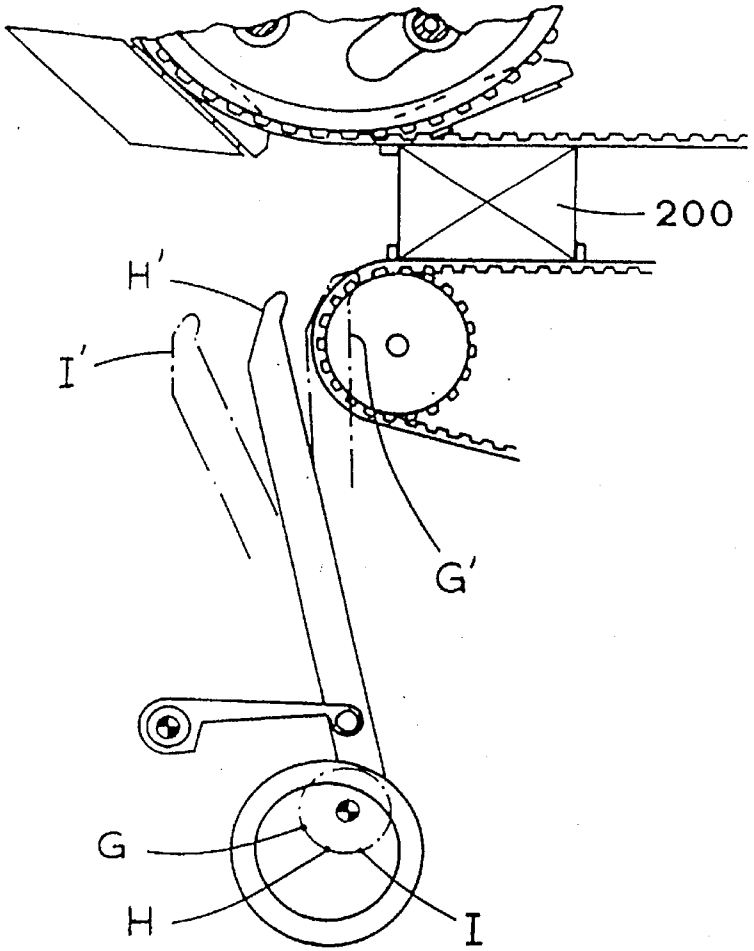
Figure 21C:
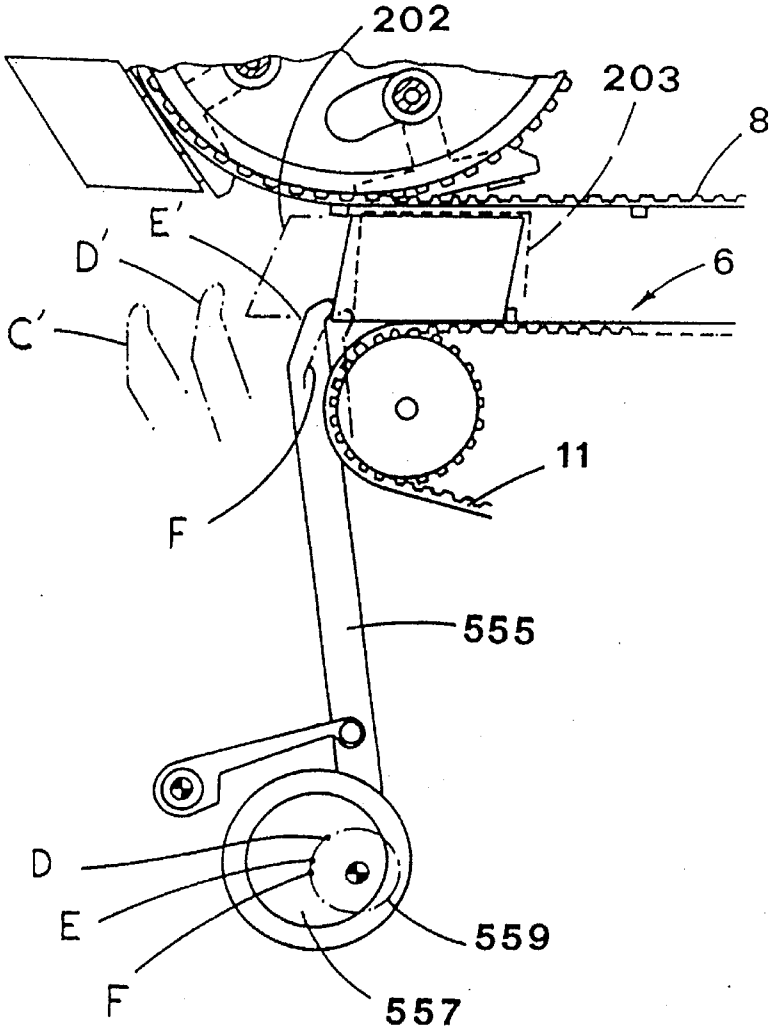

In fact, the blade 555 pushes the rear surface of the case, so that the case erects completely becoming perfectly parallelepidal, as schematically indicated by broken line 203 in FIG. 21*c*.

Afterwards, the pusher blade 555 leaves the blank 2 and goes back as shown by G', H' and I' in FIG. 21*d*, corresponding to the positions G, H and I assumed by the eccentric member 557 along the path 559.

Consequently, the opened case is gently inserted between the upper belts 8 and the lower belts 11, 12 operated in phase relation so as to receive the same blank 2 within the lugs 14, 15.

The case is held by the lugs 14, 15 of the belts 11, 12 and the lugs 10 of the upper belts 8 and is conveyed along the packaging line 6 (FIG. 21*a*).

After the opened case has been inserted between the belts 8 and 11, 12, the suction cups 519 are detached from it.

It is to be pointed out that the above mentioned lugs 10 of the belts 8 not only withdraw the blanks 2 from the magazine 3 but also trail the set up cases 200 along the packaging line 6, while cooperating with the lugs 14, 15 of the belts 11, 12, so as to maintain the correct set up position of the cases 200.

The lugs 10 of the belts 8 cooperate with the lugs 14 of the belts 12 in trailing the cases 200.

Along the feeding line 16, the articles 17 are transported in phase at the side of the cases 200 transported along the packaging line 6.

The articles 17 are pushed inside respective cases 200 by the pushers 21 driven to move longitudinally to the same line 16 and operated transversally to it (FIG. 3).

If the blank size is to be changed, it is possible to adjust the magazine 3 size by suitably changing the position of the angular guides 116*a*, 116*b*.

In particular, in order to adjust the height by suitably rotating the bar 24, the plate 22, carrying the group formed by the withdrawal station 1, the feeding line 4 and the erecting device 5, is vertically displaced so as to change the distance between the lower run of the belts 8 and the belts 11, 12 of the packaging line 6.

In order to adjust the transversal dimension, the control member 41 is acted on, so as to activate the transmission means 42, 43, and 44 that, through relative actuating means, cause translation of the belts 8 and 11, 12 situated outside the lines 4 and 6 so as to adjust the distance from the symmetric belts.

It is to be pointed out that also the transversal dimensions of the magazine 3 are adjusted in this way, since a pair of vertical guides 116*a*, 116*b* of the same magazine are translated.

The magazine 3 longitudinal dimension is changed independently by moving the carriage 129 that carries the fore guides 116*a*.

In the same independent way, the mutual distance between the side walls 156 containing the lateral flaps 2*a* of the blanks 2 is adjusted, because the length of these flaps 2*a* is in relation to the case height.

The above described machine permits to withdraw the blanks 2 from the magazine and subsequently open and feed them to the packaging line 6, as well as to fill the cases 200 obtained in this way with relative articles 17, in the best way.

It is to be pointed out that the belts 8 equipped with the lugs 10 withdraw the blanks 2 one by one, and then carry them to the erecting device 5 and then, with cooperation of the belts 11, 12 the said belts 8 define the feeding line avoiding intermediate pushing means or the like, as used in the known devices.

Thus a considerable simplification and safety of the packaging operations is obtained.

In particular, the blanks 2 are withdrawn from the magazine 3 in horizontal position that facilitates subsequent printing thereon performed by printing means placed downstream of the same magazine. Moreover, erection of the blanks 2 does not cause their damage.

Besides, the machine size can be considerably reduced and assembling and maintenance operations can be facilitated because of particular situation of the feeding line 4 and the packaging line 6, related to the placement, with respect to the above mentioned lines, of the erecting device 5, blanks magazine 3, the articles feeding line 16 and the pushers 21.

Another advantage of the proposed machine derives from the shapes, situation and combination of the means aimed at size changing.

Owing to the above mentioned characteristics, the described invention operates with high speed, so as to increase productivity in packaging operation.

It is also to be pointed out that the magazine 3 and its adjustment means are supported by a frame structure 106 that can be easily raised with respect to the feeding line 4.

This allows the feeding line 4 to be rapidly accessible for possible maintenance or similar operations.

Further advantage of the described machine is that it prevents the blanks from being damaged, specially during the withdrawal, as often occurs in conventional devices.

FIGS. 19*a*, 19*b*, 19*c* and 19*d* show another embodiment of the withdrawal station, designed particularly to withdraw and feed blanks of size bigger that the one defined by the distance between two subsequent lugs 10 adjacent to the belts 8.

According to this solution, the stop means 118 situated downstream of the magazine 3, are mounted on a horizontal pivot 181 transversal to the blank feeding line 4, so that they can oscillate.

This oscillation is elastically opposed by spring means 182 that urge on a support element 183.

Obviously, also in this case, the stop means 118 can adjusted vertically, by moving the support element 183.

In the lower part, on the side facing the magazine 3, the stop means 118 feature a shoulder 184 as thick as a single blank 2 and having the front edge suitably smoothed.

Figure 19A:
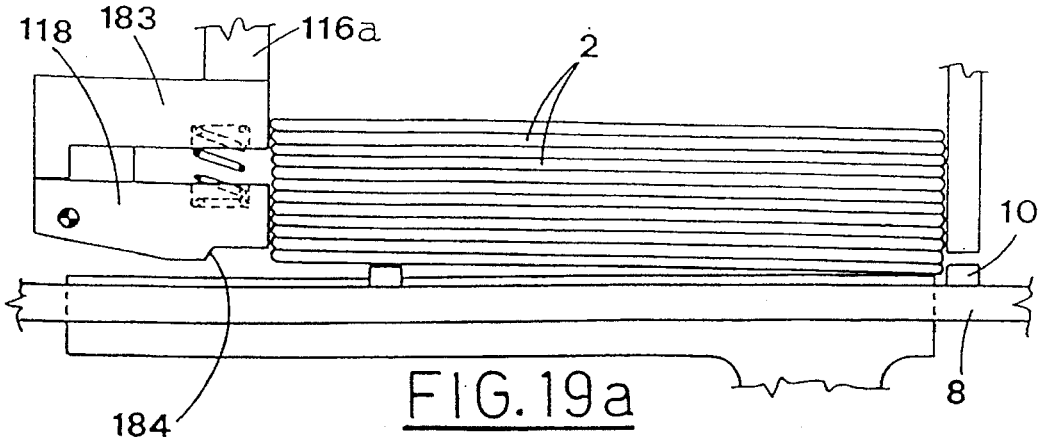
FIGS. 19*a*, 19*b*, 19*c* and 19*d* show a detailed side view of a different embodiment of the above mentioned blanks withdrawal station, in different working steps.

As seen in FIG. 19*a*, at the beginning, the front part of the stack of blanks 2 rests on a lug 10 of the belt 8 and is slightly inclined upward, considering the feeding line 4 movement; at the back, the stack of blanks 2 rests on the bars 117.

As already said, this situation occurs when the blanks 2 size is bigger than the distance between the lugs 10.

Figure 19B:
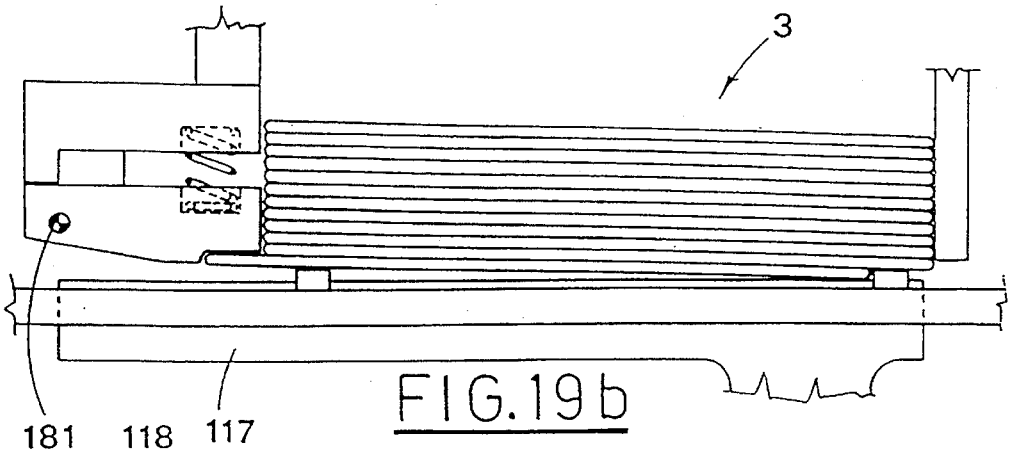

Therefore, when the belts 8 are operated, the pair of lugs 10 placed behind the lugs supporting the stack of blanks, engage the back edge of the lowermost blank 2, withdrawing it from the magazine 3 (FIG. 19*b*).

At this point, the withdrawn blank passes through the passage defined by the shoulder 184 of the stop means 118.

The upper blanks of the stack are prevented from withdrawing from the magazine 3 by the stop means 118 that hold them at the front, as clearly seen in FIG. 19*b*.

Figure 19C:
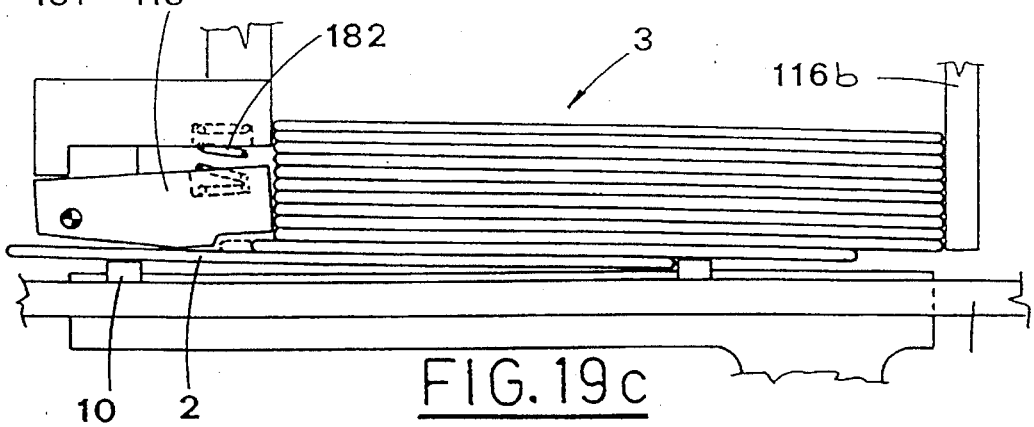

When the withdrawn blank reaches the shoulder 184, it makes the stop means 118 rotate upwards about the pivot 181 by acting on the shoulder smoothed edge and overcoming the elastic reaction of the spring means 182, so as to pass below the stop means 118 (FIG. 19*c*).

At the same time, the blank right over the one just withdrawn is trailed in the line movement direction, because of mutual friction between the blanks, and engages, with the front edge, the shoulder 184 of the stop means 118, left free by the previous blank.

Figure 19D:
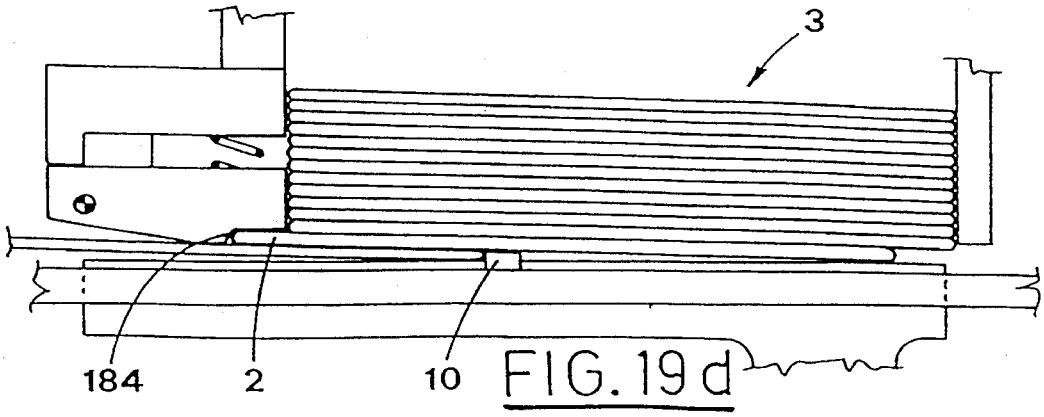

In this way, the second blank is inclined, being supported at back by the bars 117 and engaged at front with the shoulder 184 of the stop means 118 (FIG. 19*d*).

Likewise, in normal operation, other blanks 2 of the stack are withdrawn from the magazine 3.

As described, this solution allows to withdraw the blanks of different sizes, bigger than the distance between the lugs 10 of the belts 8, that is advantageous from the point of view of functionality and use versatility.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. Packaging machine for withdrawing flat folded carton blanks from a magazine where said carton blanks are stored in flat folded condition to form a stack, and for erecting and filling said cases with relative articles, including:

a blank feeding line, cantilever supported by a fixed frame structure and equipped with first belt conveying means for conveying blanks withdrawn from said magazine, in flat folded condition;

a withdrawal station where said flat folded blanks are withdrawn from said magazine, said withdrawal station being situated along said blank feeding line and equipped with bars for supporting a stack of blanks, and with stop means aimed at cooperating with the same bars so as to define a passage through which a single flat folded blank is withdrawn by the said first belt conveying means;

a carton erecting device, situated downstream of the said withdrawal station and comprising a rotary member that carries gripping means located along the periphery of the said rotary member and including suction cups mounted on respective shafts pivoting on a rotary drum coaxial to and rotated in synchrony with said rotary member;

further gripping means including suction cups situated over said rotary member and operated in phase relation with the said gripping means between a gripping position, in which said suction cups grip at opposed sides a flat folded blank, and an opening position in which adjacent wall panels of said blank are opened;

a packaging line situated below the said blank feeding line and parallel thereto, supported in cantilevered fashion by the said fixed frame structure and equipped with second belt conveying means aimed at cooperating with a lower run of said first belt conveying means, so as to hold the cases, obtained from the said blanks, while conveying them;

an article feeding line situated at the side of the packaging line, in intermediate position with respect to the said fixed frame structure for feeding articles to be packaged;

a plurality of pushers carried along a closed path, that extends along a straight section at the side of the article feeding line, moved with a speed equal to the speed of said article feeding line, said pushers being operated axially when they run the above mentioned straight section, so as to push the articles inside respective cases;

first adjustment means aimed at moving vertically a group comprising the said withdrawal station, said blank feeding line, and said carton erecting device, for adjusting height of said group in accordance with the height of the cases to be packaged, in such a manner that the distance between the lower run of the said belts conveying means first and second of the said packaging line is changed accordingly;

second adjustment means equipped with a centralized control member aimed at operating, by means of flexible transmission means, actuating means for changing width of the blank feeding line, of the packaging line and of the magazine in accordance with the length of the cases to be packaged.

2. Machine according to claim 1, wherein the said first belt conveying means feature a plurality of lugs set regularly spaced apart on an outer surface of said first belt conveying means, and protruding upward beyond the resting plane defined by the upper surface of said bars of the withdrawal station, said lugs being aimed at engaging the rear edge of the lowermost blank, so as to withdraw it by stripping through the passage, also said second belt conveying means carrying a plurality of lugs set regularly spaced apart on an outer surface of said second belt conveying means, and aimed at acting as fore and rear stops for the already set up carton and at cooperating with said lugs of said first belt conveying means during the transport along said packaging line.

3. Machine according to claim 1, wherein said first adjustment means include a longitudinal bar, that is rotatably supported by said fixed frame structure and that has a plurality of bevel pinions in meshing engagement with respective ring bevel gears set on an end of screw means that are rotatably supported, with vertical axis, by brackets integral with the fixed frame structure, said screw means being connected with respective female screw means on support means that are fastened to a plate vertically movable and carrying the group including the withdrawal station, said blank feeding line and said carton erecting device.

4. Machine according to claim 3, wherein said first adjustment device can be locked in the working position by brakes comprising a locking bar that passes through support means with possibility to rotate and with longitudinal axis parallel to the bar, said locking bar carrying at least one eccentric bushing on which a block is mounted, aimed at being fastened to the said fixed frame structure due to rotation of the locking bar.

5. Machine according to claim 1, wherein the said control member of the second adjustment means has a rotary bar that rotates around an axis transversal to the machine, the said rotary bar carrying a pair of side by side pulleys keyed on an end of said rotary bar turned toward the inner part of the machine, transmission means being trained around said side by side pulleys so as to transversely adjust the said packaging line, said rotary bar being also designed to simultaneously rotate, by transmission means, another shaft transversal to the machine, with keyed thereto a pulley around which a further transmission means is trained, so as to adjust transversely the said feeding line and the said magazine.

6. Machine according to claim 1, wherein the said actuating means of said second adjustment means are provided, in correspondence with pulleys around which transmission means are trained, with a sleeve movable axially along a tube, integral with the fixed frame structure, and operated by a relative female threaded means, said sleeve also featuring, integral therewith, respective plate rotatably carrying respective coupled pulleys (13,13a) of said second belt conveying means of said packaging line, so as to allow the said coupled respective shaft with respect to the pulleys (13,13*a*) to translate transversally on the pulleys, for transversal adjustment of the first belt conveying means of said blank feeding line.

7. Machine according to claim 1, wherein the said magazine is carried by a frame, articulated to a lever that oscillates on a longitudinal vertical plane, and is designed to move the magazine to a raised position with respect to an underlying blank feeding line, defined by the said first belt conveying means.

8. Machine according to claim 1, wherein the said magazine has vertical guides, respectively a fore guide and a rear guide with respect to the moving direction of said first belt conveying means, a magazine longitudinal dimension being adjustable by means of said fore guides which are supported by a carriage made to slide longitudinally by racks.

9. Machine according to claim 1, wherein the said bars are supported in such a way that they can move vertically so as to adjust, by means of adjusting element, the width of the said passage, said adjusting element comprising a slide slidably guided in a vertical slot of each bar and that can be locked to a related wall of the fixed frame by means of a locking member, with the said slide featuring, in its lower part, a plate, that in use position is aimed at defining, with respect to a lower margin of said wall, a passage having height equal to the one defined by the bars, and that in adjustment is designed to elastically tighten a blank by thrust of spring means.

10. Machine according to claim 1, wherein including rocker means situated under said magazine and pivoted to a frame of the same magazine by means of an axis transversal to said first conveying means, said rocker means being moved by related jacks from a lowered position, in which normal working of the machine occurs, and a raised position, in which said rocker means raise the stack of blanks preventing said lugs from withdrawing a blank.

11. Machine according to claim 1, wherein said magazine includes a pair of vertical small belts situated at both sides for guiding lateral flaps of said blanks, said small belts being operated by respective gearmotor means so as to push downwards edges of said lateral flaps until they touch a rest plane, and being adjustable in direction transverse to said first belt conveying means, independently with respect to each other, by means of respective support means moved by related threaded shaft rotated so as to give motion to female threads made in said support means.

12. Machine according to claim 1, wherein said magazine has at the top a pair of vertical side walls for holding said blanks, said side walls being supported by a frame of said magazine and being adjustable in direction transverse to said first belt conveying means by means of respective slide blocks slidingly and symmetrically movable, in direction transverse to said first belt conveying means, by means of respective threaded shafts rotated to give motion to female threads made in said slide blocks.

13. Machine according to claim 1, wherein said stop means pivot, against elastic spring means, on an horizontal axis transverse to said first belt conveying means, with a shoulder being featured at bottom of said stop means and turned towards said magazine, said shoulder having height equal to the thickness of a single blank so that a front edge of the stack lowermost blank set inclined inside the magazine and resting with its rear part on said bars, engages said shoulder while being withdrawn making said stop means pivot upwards.

14. Machine according to claim 1, wherein said rotary member of the case erecting device includes a plurality of gripping means with suction cups mounted in couples, via respective radial arms, on related shafts angularly spaced apart and located between two pulleys connected to said first belt conveying means, said shaft being carried by said rotary drum by means of crank means so that they pivot, said rotary drum being rotated in coaxial relation and in synchrony with said pulleys; an operating device being provided and equipped with cam means for engagement with said rocker means carried by said rotary drum, so as to cause rotation of said crank means bearing said shafts.

15. Machine according to claim 1, wherein said carton erecting device includes a pusher means equipped with blade means for pushing the back of said blanks while said blanks are transferred to the packaging line.

16. Machine according to claim 15, wherein said blade means extends from a head rotatably mounted on an eccentric member rotated by a driving shaft, with a connection rod pivoting by means of a gudgeon having stationary axis, and articulated to the pusher blade, so that said blade means oscillates on a vertical plane longitudinal with respect to the packaging line.

17. Machine according to claim 1, wherein said carton erecting device includes a yielding roller situated downstream of the section of the machine in which the blanks are gripped by said gripping means with suction cups, said yielding roller being rotated around an axis parallel to the axis of said rotary member so as to engage a fore edge of said blanks in erecting step, so that said blanks are back folded

18. Machine according to claim 1, wherein said further gripping means are driven by a crank mechanism set at blank feeding line outlet, over said rotary member, and equipped with at least one supporting bar for said suction cups, said supporting bar being articulated to a pair of cranks rotated around horizontal axes parallel to the axis of said rotary member, so that said supporting bar is moved on a longitudinal vertical plane while keeping its horizontal attitude.

* * * * *